US007682994B2

(12) United States Patent
Van Emden et al.

(10) Patent No.: US 7,682,994 B2
(45) Date of Patent: Mar. 23, 2010

(54) BREATHABLE FABRIC

(75) Inventors: Oliver Van Emden, Middlesex (GB); Chris Carr, Cheshire (GB)

(73) Assignee: Lightex Limited, Edgware, Middlesex (GB)

( * ) Notice: Subject to any disclaimer, the term of this patent is extended or adjusted under 35 U.S.C. 154(b) by 0 days.

(21) Appl. No.: 11/573,240

(22) PCT Filed: Jul. 13, 2005

(86) PCT No.: PCT/GB2005/002766

§ 371 (c)(1),
(2), (4) Date: Apr. 24, 2007

(87) PCT Pub. No.: WO2006/013317

PCT Pub. Date: Feb. 9, 2006

(65) Prior Publication Data

US 2008/0096001 A1 Apr. 24, 2008

(30) Foreign Application Priority Data

Aug. 4, 2004 (GB) ..... 0417371.2

(51) Int. Cl.
*D03D 15/00* (2006.01)
*D03D 25/00* (2006.01)

(52) U.S. Cl. ..... 442/181; 442/79; 442/82; 442/304; 442/313; 264/103

(58) Field of Classification Search ..... 442/304, 442/313, 79, 82, 181; 264/103
See application file for complete search history.

(56) References Cited

U.S. PATENT DOCUMENTS

| | | | | |
|---|---|---|---|---|
| 4,733,546 | A * | 3/1988 | Toda | 66/202 |
| 5,065,600 | A | 11/1991 | Byles | |
| 5,269,720 | A | 12/1993 | Moretz et al. | |
| 5,312,667 | A * | 5/1994 | Lumb et al. | 428/91 |
| 5,319,807 | A | 6/1994 | Brier | |
| 5,364,678 | A | 11/1994 | Lumb et al. | |
| 5,414,870 | A | 5/1995 | Moretz et al. | |
| 5,435,014 | A | 7/1995 | Moretz et al. | |
| 5,508,098 | A | 4/1996 | Omar et al. | |
| 5,787,503 | A | 8/1998 | Murphy, III | |
| 6,509,285 | B1 * | 1/2003 | Yeh | 442/195 |
| 2002/0155771 | A1 | 10/2002 | Soane et al. | |
| 2003/0181118 | A1 | 9/2003 | Ko et al. | |
| 2005/0101209 | A1 * | 5/2005 | Li et al. | 442/118 |

FOREIGN PATENT DOCUMENTS

| | | |
|---|---|---|
| EP | 0602986 | 6/1994 |
| GB | 1092082 | 11/1967 |
| GB | 2401302 | 11/2004 |
| WO | 03001934 | 1/2003 |
| WO | 2004089614 | 10/2004 |

* cited by examiner

*Primary Examiner*—Norca L Torres-Velazquez
(74) *Attorney, Agent, or Firm*—Senniger Powers LLP

(57) ABSTRACT

A fabric comprising a textile layer comprising yarns, wherein said textile layer is permeable to water vapour and impermeable to liquid water; and disposed on at least part of one side of the textile layer is a wicking means.

22 Claims, 5 Drawing Sheets

Figure 1:
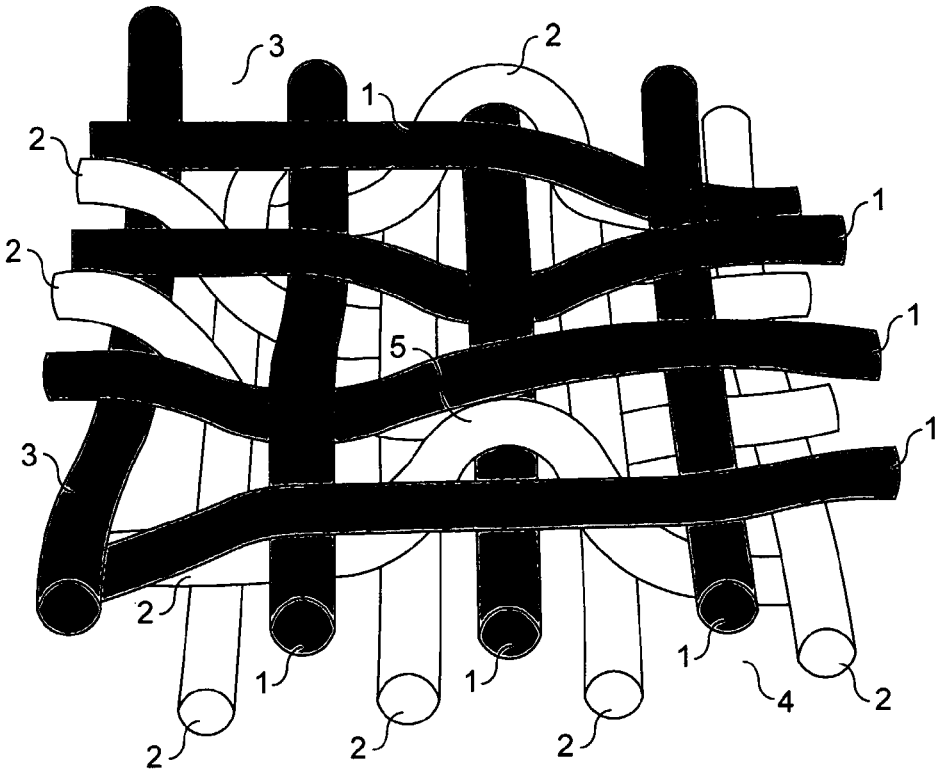

Threading 120 epi
160 epi

Weft: Peg Plan

Warp: Yarn Descriptions

| Color | Name | Ends | % | Description |
|---|---|---|---|---|
| A | Ecru | 8 | 100 | 80/2 Ne WR |

Weft (Fill): Yarn Descriptions

| Color | Name | Ends | % | Description |
|---|---|---|---|---|
| a | White | 8 | 50.0 | 50/1 Ne white cotton |
| b | Ecru | 8 | 50.0 | 80/2 Ne WR |

Weft: Colour Arrangement

| | 8 | | Total |
|---|---|---|---|
| a | 1 | | 8 |
| b | | 1 | 8 |
| | | | 16 |

BREATHABLE FABRIC

CROSS-REFERENCE TO RELATED APPLICATIONS

The present application is based on and claims the benefit of International (PCT) Application Serial No. PCT/GB2005/002766, filed on Jul. 13, 2005, which claims priority from GB Pat. No. 0417371.2, filed on Aug. 4, 2004. The entire content of this application is incorporated herein by reference.

The present invention relates to the field of fabrics, particularly those suitable for making clothes. The fabric constructions of the present invention are novel, breathable fabrics that may be made into clothing garments such as shirts or trousers.

Breathable fabrics are known in the prior art. One of their main uses is in outerwear, to prevent ingress of water, in the form of rain or snow, into a garment. One technique used in the prior art is to apply a water-repellent coating to the exterior of the woven fabric of a garment. If the coating is breathable, i.e. able to allow water vapour but not liquid water through the coating, this allows moisture vapour to escape. However, applying coatings to fabrics increases the rigidity and handle of fabrics, while also decreasing the coating's inherent breathability. Traditional coatings do not appear to be very durable, with their strength and breathability being significantly reduced over a number of washing cycles. In general, a water-repellent coating will tend to have a lower water resistance than a breathable membrane of the same thickness. This sometimes leads to coatings being referred to as 'water-resistant', while breathable membranes are essentially 'water-proof'.

In order to apply a coating to effectively 'water-resist' a garment, it is often necessary to apply a relatively thick coating. Garments made in this way tend to have a rigid, low drape handle and as such are only appropriate for items of clothing for outerwear, such as jackets. Application of such coatings to a traditional woven cotton shirt, for instance, would result in a very stiff uncomfortable garment unsuitable for normal wear. Additionally, a shirt coated with a traditional water-repellent coating, even if the coating was breathable, would result in a build-up of a wearer's perspiration on the inside of the garment and leaving the wearer hot, sticky, wet and uncomfortable.

If a water-repellent coating were applied onto the interior side of a shirt fabric, for instance if it were desired to prevent the visibility of sweat patches when wearing the shirt, this again would not be satisfactory. If a wearer of the shirt was to sweat constantly over a period of time, then friction of the fabric against the moist skin, combined with the build-up of perspiration in a concentrated area would make the water repellency rub off, and the perspiration would then be absorbed into the fabric, e.g. cotton, shirting material. This would be in addition to the uncomfortable feeling of the build-up of water next to a wearer's skin since the water-repellent layer would be in closest contact with the skin.

WO 01/34080 discloses a launderable, leakproof, breathable fabric. The fabric consists of two juxtaposed layers. The inner layer comprises absorbent acetate fibres. The outer layer is a vapour permeable microporous polyurethane film.

EP-A-0542491 discloses a multi-layer fabric for a garment. The layers include, listed in their relative positions with the most internal layer being first: a thick moisture permeable hydrophobic fabric layer, comprising, for example, polyester; a first relatively thin hydrophilic fabric layer that may comprise nylon; a second relatively thick hydrophilic fabric layer, which may be buffed or brushed in order to provide a "storage" layer for water; a breathable membrane and an outer layer of the fabric garment.

A feature of impermeable garment constructions is the potential for moisture build-up and subsequent microbial growth leading to odour.

Another feature of high physical activity in humans wearing clothes is the generation of heat and associated perspiration inside the garment, i.e. in the wearer's "microclimate". The perspiration can be absorbed by the garment, which is in contact with the skin, and produce an obvious discolouration, which will appear unsightly and embarrass the wearer. A possible solution to this problem is to apply disposable absorbable pads under the arms. These pads are separable components of the garment, easily visible, but will absorb the moisture. Furthermore disposable breathable pads and liners display other disadvantages in that they tend to be non-reusable or non-washable and thus a user must keep purchasing and adhering the liners or pads to articles of clothing as and when required.

It would therefore be advantageous to provide a breathable fabric having improved sanitary properties that is as comfortable as possible. It would also be advantageous to provide a breathable fabric in which sweat and moisture in liquid form could be kept away from a user's skin and wicked away by the breathable fabric.

It would furthermore be advantageous to provide fabric articles especially clothing articles, that are breathable, which have sanitary properties, and preferably which prevents visible moisture build-up on or within the article. The visibility of the moisture absorption is important in shirting materials. There is a need to produce a garment or article of clothing that is able to mitigate the visibility from the exterior of the garment of perspiration produced by the wearer.

Recent developments in the field include garments made from a three layer laminate. Such garments, are disclosed in PCT application PCT/GB2004/001479 (unpublished at the time of filing the present application). An embodiment disclosed in this application was a garment made from the laminate, wherein the three layers include a breathable membrane, on the outer side of which is a fabric layer permeable to water vapour and on the inner side of the breathable membrane is a layer comprising sanitary agents. While the invention disclosed in this application went some way to providing a drapable, comfortable fabric, further improvements on this technology have been made by the present inventors.

All the breathable layered materials mentioned in the three documents above go some way to providing a material that can be made into a clothing garment that allows a wearer's perspiration to pass through in the form of water vapour, while preventing liquid water from discolouring, or producing a perspiration mark, on the exterior of the clothing. However, further improvements ideally could be made to the feel, drape and handle of the garments. It is believed that it may be possible to produce a clothing fabric that has a closer feel, drape and handle to that of traditional, single layer, fabric materials such as cotton, wool, polyester and the like.

It is therefore an aim of preferred embodiments of the invention to overcome or to mitigate at least one problem of the prior art, whether expressly disclosed herein or not.

The present invention provides a fabric comprising a textile layer comprising yarns, wherein said textile layer is permeable to water vapour and impermeable to liquid water; and disposed on at least part of one side of the textile layer is a wicking means.

The present invention provides a textile fabric, preferably for forming an article of clothing, said fabric comprising a textile layer, wherein said textile layer is permeable to water vapour and impermeable to liquid water;

said textile layer has an interior side, which, in use, faces the intended wearer of the article and an exterior side, which, in use, faces away from the intended wearer of the article; and disposed on at least part of the interior side of the textile layer is a wicking means.

The present invention will now be described further, by way of example only, with reference to the following drawings, in which:

FIG. 1 shows a fabric having an 'upper' layer of hydrophobic warp and weft yarns (1) and a 'lower' layer of wicking warp and weft yarns (2) comprising low denier fibres. It can be seen that the lower yarns are interwoven with the upper yarns. This type of fabric is termed a '1 & 3 twill fabric with weft stitch.' The side of the fabric (3) comprising hydrophobic warp and weft yarns is water repellent and the side of the fabric (4) comprising wicking warp and weft yarns is wicking.

Figure 2:
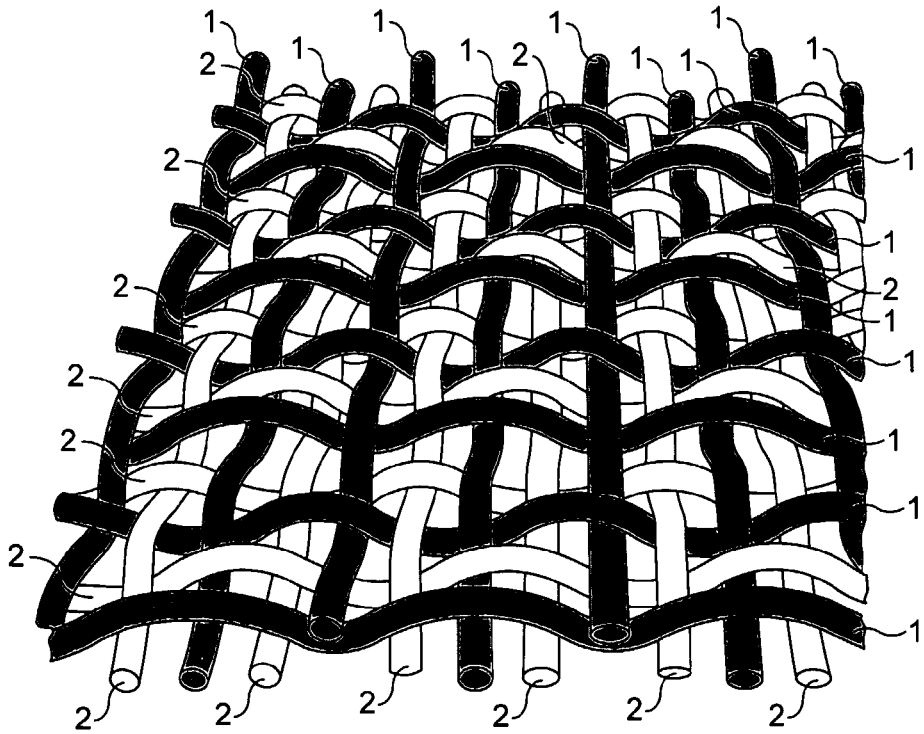

FIG. 2 shows a fabric having an 'upper' layer of hydrophobic warp and weft yarns (1) and a 'lower' layer of wicking warp and weft yarns (2) comprising low denier fibres. This type of fabric is termed a '1 & 1 Twill with stitch.'

Figure 3:
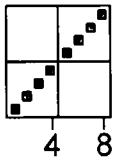
Figure 3:
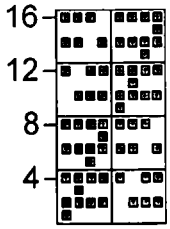
Figure 4:
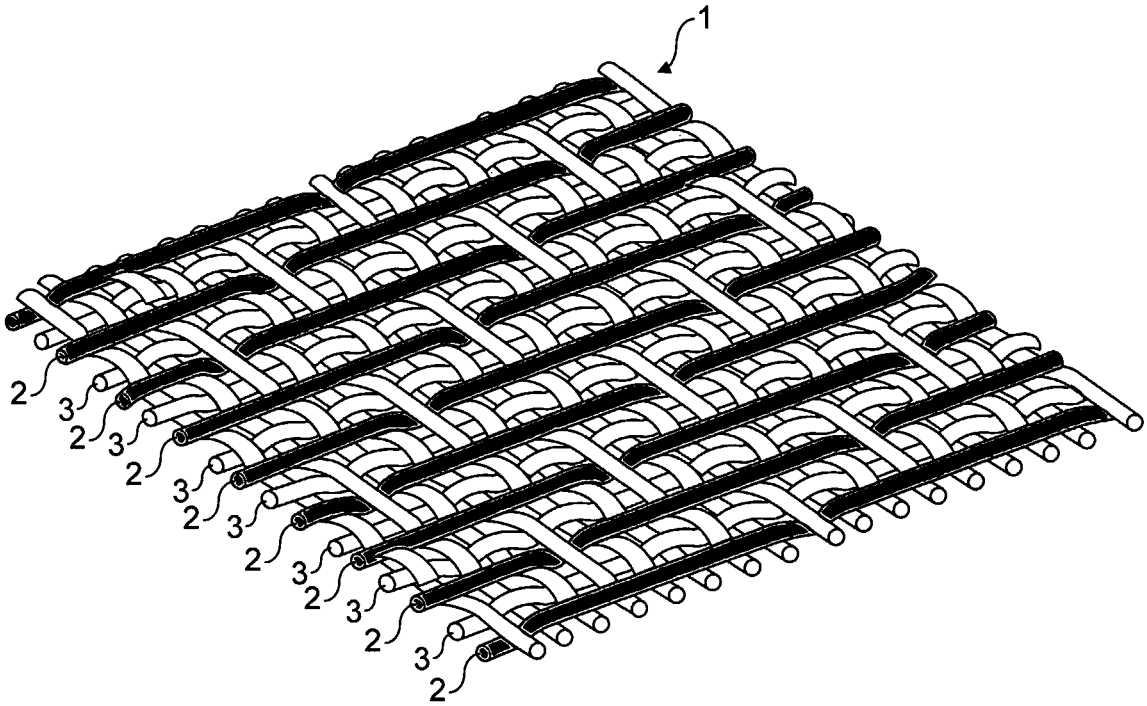

FIG. 3 shows a weaving pattern for making the single-weave fabric of Example 5, FIG. 4 shows the fabric made according to the pattern of FIG. 3, wherein in FIG. 4 (1) represents hydrophobic cotton warp yarns (80/2 Ne WR), (2) represents the wicking cotton weft yarns (50/1 Ne white cotton) and (3) represents the hydrophobic weft yarns (80/2 Ne WR). All yarns parallel to the yarn marked (1) are also hydrophobic warp yarns.

Figure 5A:
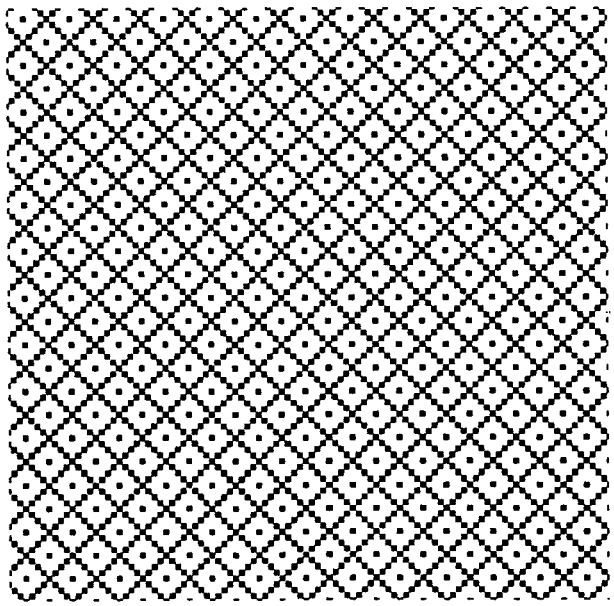
Figure 5B:
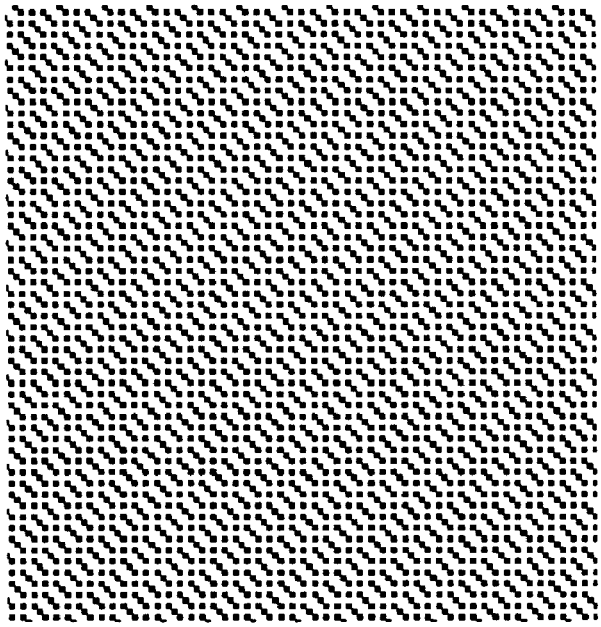
Figure 5C:
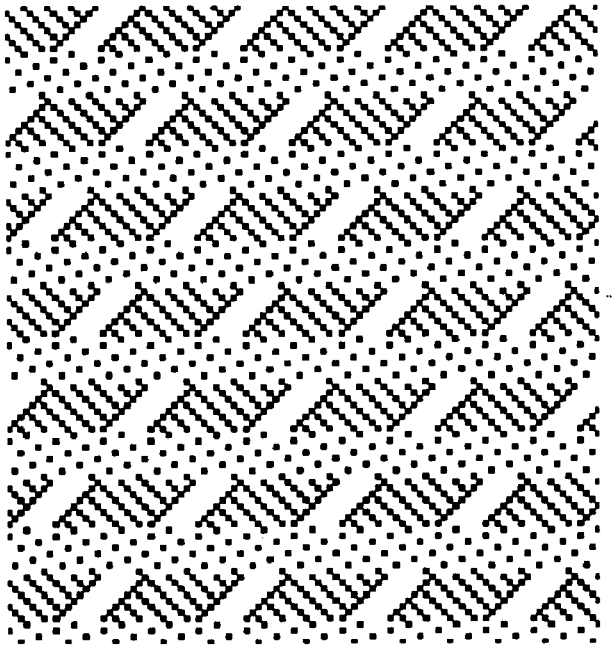
Figure 5D:
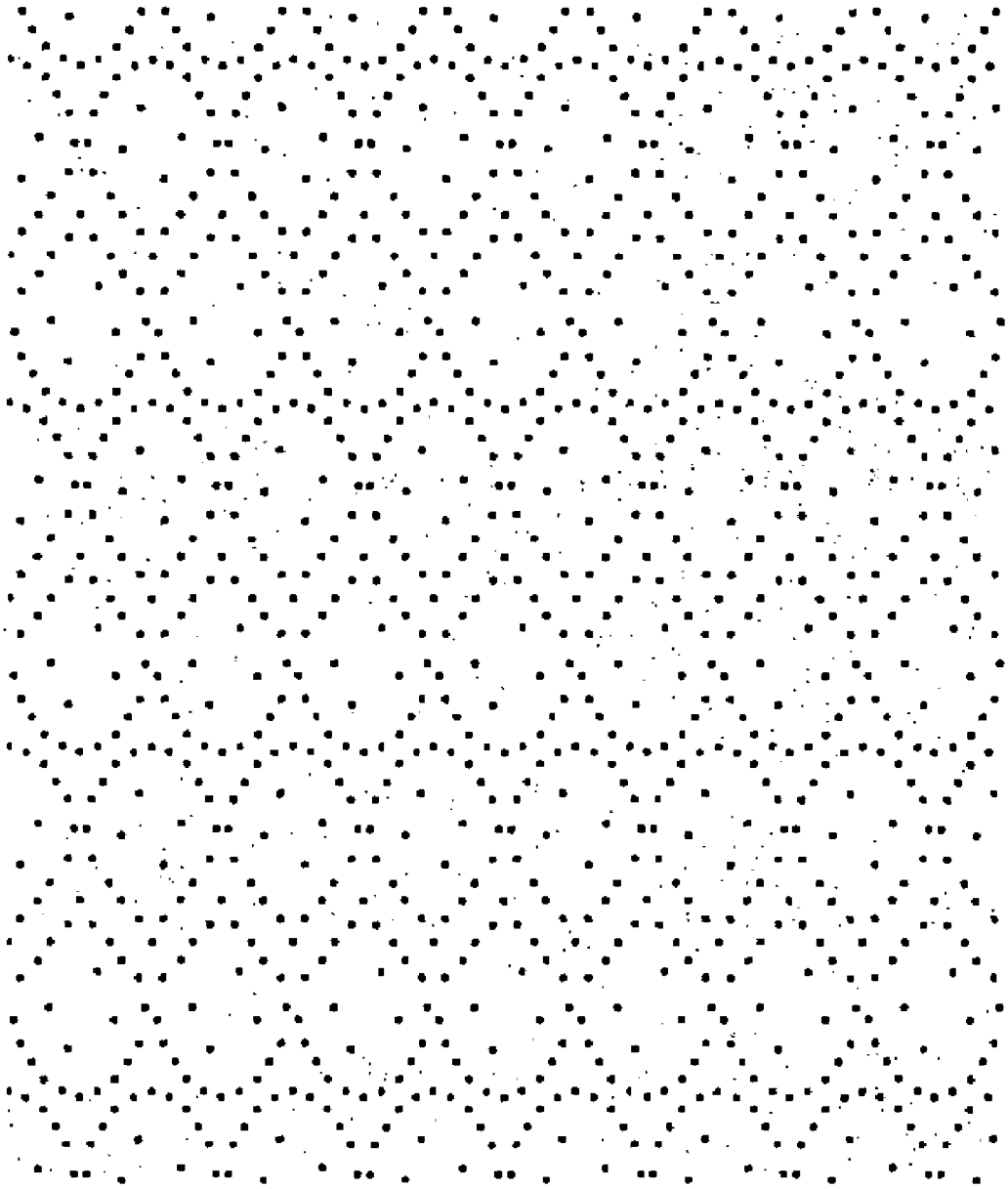

FIGS. 5A to 5D show examples of the inner (wicking) face of a fabric of the present invention. The black markings represent hydrophobic yarns and the white marking represent wicking yarns. It is clear that the majority of the yarns visible on the inner face are wicking yarns. FIGS. 5A to 5C show single-weave fabrics, wherein the hydrophobic yarns are warp and weft yarns and the wicking yarns are floating weft yarns, which are integrally woven with the hydrophobic yarns. FIG. 5D shows a double-weave fabric, which comprises a first layer (not shown in figure) comprising warp and weft hydrophobic yarns and a second layer (shown in figure), integrally woven with the first layer, comprising wicking warp and weft yarns. Over 97% of the yarns on the surface of the wicking layer are wicking yarns.

In each of diagrams 5A to 5D, substantially only hydrophobic yarns would be visible from the other side of the fabric.

The present invention will now be further described. In the following passages different aspects of the invention are defined in more detail. Each aspect so defined may be combined with any other aspect or aspects unless clearly indicated to the contrary. In particular any feature indicated as being preferred or advantageous may be combined with any other feature or features indicated as being preferred or advantageous.

The wicking yarns or fibres may be interwoven with, interknitted with, or sewn to, the yarns of the textile layer, which are preferably hydrophobic.

The textile layer is preferably formed from yarns that are woven, non-woven or knitted to form the layer, preferably the yarns are woven or knitted.

The textile layer is, in itself, permeable to water vapour and impermeable to liquid water. This is preferably due to the hydrophobic nature of the yarns or yarn fibres. Preferably, the yarns/yarn fibres of the textile layer are hydrophobic yarns/yarn fibres, which includes yarns/yarn fibres that are inherently hydrophobic or hydrophilic yarns/yarn fibres that have either been treated with a coating, additive or finish, and/or have hydrophobic molecular moieties bound to the yarns/yarn fibres, to render them hydrophobic. The fabric may be formed from hydrophobic yarns or, alternatively, formed from hydrophilic yarns, which are treated as part of the textile layers to become hydrophobic yarns. The resultant textile layer will ideally be formed from yarns/yarn fibres that are sufficiently hydrophobic to ensure that the textile layer is permeable to water vapour but impermeable to liquid water. The textile layer may be hydrophobic due to a very tight knit or weave structure of hydrophobic yarns/yarn fibres. If the yarns/yarn fibres are hydrophobic, for example polyester, or hydrophilic, for example cotton yarns, these yarns/yarn fibres may have hydrophobic moieties as described herein bound to the individual yarns/yarn fibres to ensure the textile layer made therefrom is permeable to water vapour but substantially impermeable to liquid water. The yarns may be hydrophobic due to the yarn fibres that constitute the yarns being hydrophobic. Such textile layers do not require a further breathable membrane or breathable coating across the surface of the fabric to impart 'breathability', in contrast to those mentioned in the documents above and many others of the prior art. A "breathable" substance is one that has the ability to be permeable to water vapour and impermeable to liquid water. Under normal wearing conditions, an article made from the fabric of the present invention will ideally allow perspiration through its textile layer in the form of vapour, but not allow the perspiration to pass through as liquid. The skilled person would understand that "impermeable" includes "substantially impermeable" and "permeable" includes "substantially permeable", and that both terms generally refer to the properties of the materials under the pressures and temperatures a clothing garment would normally encounter in use.

"Fabric" includes the definition given in the Collins Concise English Dictionary, published in 2001, as "any cloth made from yarn or fibres by weaving, knitting, felting, etc." The fabric may comprise a plurality of layers.

"Wicking" is defined as the drawing of moisture away from a surface, which, in the context of the present invention, may be the skin. Wicking can be solely due to capillary action, as in the case of polyester or it may be a form of absorbency, as with cotton. Wicking may be due to hydrophilic properties.

The wicking means may comprise in a preferred embodiment a wicking element such as wicking fibres or wicking yarns. "Wicking fibres/yarns" refers to wicking fibres/yarns that are able, when attached to the textile layer, to wick. Wicking fibres/yarns may be wicking due to (i) their inherent wicking properties of the material from which they are made, (ii) the combination of many fine wicking fibres on the textile layer which allows them to wick due to capillary action, or (iii) a wicking coating or treatment or a hydrophilic coating or treatment that has been applied to the fibres, yarns, fabric or garment and which may be applied before or after fires are adhered to or integrally knitted or sewn or woven into the textile layer. Polyester, for example, is a substance that is not absorbent and in itself is hydrophobic. However, a cluster of fine fires made from polyester has the ability to wick water due to capillary action. The wicking yarns may comprise fibres which are not, in themselves, effective at wicking, but do wick when they form part of the yarn or fabric. Preferably, the wicking fibres or yarns are inherently hydrophilic or have been rendered hydrophilic, preferably by the application of a hydrophilic additive, coating or finish. The wicking means may be due to a surface effect on the textile layer, for instance if some of the wicking yarn/yarn fibres are raised above the surface of the textile layer, e.g. by brushing. The surface effect may be created by a finish or a process, which provides the textile layer with an uneven surface effect which enhances wicking performance, i.e. an inner surface with peaks and troughs. The surface of the fabric may be wicking due to the yarns/yarn fibres having been subjected to a brushing or other mechanical treatments, such as calendering, embossing, emerizing, raising, napping, sueding and shearing. The wicking means may be due to applying a hydrophobic coating to the textile layer, the coating having gaps therein, the gaps being adapted to allow water to pass through due to capillary action. The textile layer and the wicking means may together form a tufted material, wherein the pile of the tufted material comprises the wicking means, and the textile layer forms a backing layer of the tufted material into which the pile has been sewn.

Preferably, the yarns of the textile layer comprise polyester, polyamides, polyvinyl alcohols, lyocell, rayon, viscose, nylon, cotton, linen, flax, hemp, jute and wool, acetates, acrylic, elastane, silk or any combination thereof. The hydrophobic yarns of the textile layer, may comprise cotton fibres, polyester fibres, polyamide fibres, acrylic fibres, wool fibres, silk fibres, linen fibres, synthetic fibres, viscose fibres, elastane fibres or a combination thereof. The yarns of the textile layer may have been rendered hydrophobic by a water repellent finish, either before or after forming the textile layer.

The yarns of the textile layer may comprise blended yarns, which each contain a combination of two or more different types of fibres or yarns, e.g. a cotton yarn and polyester yarn. The hydrophobic yarns, which may be hydrophilic yarns treated with a water repellent finish, may comprise bicomponent yarns or bicomponent fibres. A bicomponent yarn may be defined as "a yarn having two different staple fibre and/or continuous filament components, e.g. two singles filament yarns of different fibres twisted together." (The Anstey Weston Guide to Textile Terms). A bicomponent fibre may be defined as "a man made fibre where more than one polymer for each filament is extruded through each hole in the spinneret" (The Anstey Weston Guide to Textile Terms).

If the hydrophobic yarns of the textile layer are cotton yarns, these cotton yarns may be 2 ply cotton, which has been found improve the weaving process. If the hydrophobic yarns comprise polyester, for example, these hydrophobic yarns may be twisted yarns to improve the weaving process.

The yarns of the textile layer may be treated with a water repellent finish to render them hydrophobic. These finishes may comprise any suitable component, which include, but are not limited to, fluorocarbons, hydrocarbons, fluorinated hydrocarbons, silicones, silicon oxides, metals, waxes, paraffins, polysiloxanes, fluorine compounds, hyper-branched polymers having hydrophobic residues (dendrimers), star polymers, fluorocarbon polymers attached to hydrocarbon matrix and dendrimers, Hybrid Polymer Nanolayers, Ultra thin polymer films, nanocoatings, ceramic polymers, polyurethanes, polyamino acids, polyamides, rubbers, polyolefins, acrylates, polytetrafluoroethylene, polyethers, polyfluoroethylene, or copolymers thereof. The yarns and/or the textile layer may be subjected to other treatments, which may render the yarns hydrophobic, such as, for example: plasma treatments, electric discharge treatments, Hot Filament Chemical Vapour Deposition (HFCVD), Fusing/bonding a water repellent fibre to a wicking fibre, and attaching hydrophobic whiskers to the yarns/yarn fibres.

The yarns of the textile layer are preferably treated with a water repellent finish at the polymer stage during fibre manufacturing, the fibre synthesis stage, fibre extrusion stage, fibre stage, yarn extrusion stage or yarn stage, i.e. preferably before forming the textile layer, by weaving, knitting, or otherwise, from these yarns. The yarns may be treated with the stain and/or water repellent finish once the yarns are on a bobbin. The yarns may be treated with stain and/or water repellent finishes by an exhaust process on to the yarn.

The yarns for forming the textile layer may be treated with a fluorocarbon finish. Fluorocarbon finishes are known to the skilled person. A fluorocarbon finish is generally applied to yarns, which are then weaved to form a fabric, which is then cured to 'fix' the fluorocarbon finish. Preferably, however, the fluorocarbon finish is applied and cured prior to forming the textile layer from the yarns. This is particularly advantageous if the wicking fibres/yarns are integrally woven or knitted with the hydrophobic yarns of the textile layer. It has been found that the method of curing the fluorocarbon finish of the textile layer after forming the fabric by integrally weaving the yarns of the textile layer with wicking yarns is unsatisfactory, since the wicking properties of the wicking fibres are diminished. If the fluorocarbon finish is not fixed before the knitting/weaving process, combining the wicking yarns with the hydrophobic yarns/fibres (particularly polyester microfibres) some of the fluorocarbon finish migrates to the wicking yarns/fibres, which increases their hydrophobicity and decreases their ability to wick. This may be avoided to some extent, if not completely, by applying and fixing the hydrophobic finish prior to forming the textile layer from the yarns.

The yarns of the textile layer, preferably prior to forming the textile layer, may be treated with a finish comprising a fluorocarbon and a non-fluoro hydrocarbon polymer. This is particularly advantageous if the yarns of the textile layer are integrally woven or knitted with wicking yarns/fibres. The tendency for the hydrophobic fluorocarbons to migrate to the wicking fibres has been found to be much reduced by combining a non-fluoro hydrocarbon polymer with the with the fluorocarbon polymer, the exact reasons for which are not fully understood. A particularly preferred finish comprises a fluorocarbon, a non-fluoro hydrocarbon polymer and one or more dendrimers. Such a finish is sold under the tradename Rucostar E3 by Rudolf Chemie. While not being bound by theory, it is believed that this finish improves the bond between the fluorocarbon and the yarn, allowing fewer fluorocarbons to be used. Preferably, an anchoring interlayer and/or a cross linking agent is/are applied to the surface of the yarn prior to applying the fluorocarbon finish. The anchoring layer may comprise Poly(glycidylmethacrylate) (PGMA).

The wicking yarns/fibres may be treated with a hydrophilic additive, coating or finish, preferably at yarn level, i.e. before incorporation of the wicking yarn/fibre into the fabric of the present invention (which may be before the fabric of the present invention is formed by knitting or weaving the wicking yarns with the yarns of the textile layer). This has been found to reduce migration of hydrophobic finishes, particularly fluorocarbon finishes, from the hydrophobic yarns to the wicking yarns, particularly polyamide yarns. By applying a hydrophilic finish to the synthetic yarn, it is not essential to fix the fluorocarbon yarn/yarn fibres before the knitting or weaving process. Without being bound by theory, this treatment is believed to be successful due to the inner yarns/yarn fibres having a relatively high surface energy. The hydrophilic additive, coating or finish, may comprise one or more of the following: polyethylene oxide, a sulfoisophthalic acid copolymer, an amine compound, an alcohol, a polymer having on its side chains carboxyl groups or hydroxyl groups, carboxylic acids, salts of carboxylic acids, amides, urethanes, a compound having an oxyalkylenated group, and the like. If the inner yarn is cotton, little or no migration occurs as cotton is intrinsically hydrophilic, therefore the outer hydrophobic yarn does not have to be fixed with the fluorocarbon before the knitting/weaving process.

A material, such as the surface of a yarn or fabric, may have a high surface energy or a low surface energy. For example, a material having a surface that has a significant amount of polar, hydrophilic groups, such as hydroxyl groups, carboxylic acid groups, amine groups, and the like, generally exhibits a high surface energy. Conversely, a substrate having a surface that contains a significant portion of non-polar, hydrophobic groups, such as silicone, fluorinated groups, and the like, generally exhibits a low surface energy. When a polar liquid, such as water, is placed in contact with the surface of a substrate, the liquid will spontaneously wet the surface only if the surface tension of the liquid is lower than the surface energy of the substrate. If the surface tension of the liquid is higher than the surface tension of the substrate, spontaneous wetting will not readily occur, and the liquid will remain on the substrate's surface. A high surface energy surface describes a surface, such as cotton, that can be spontaneously wet (i.e. the contact angle of water, at 25° C., is less than 90°) by lower surface tension liquids, such as water. A low surface energy surface, such as Teflon, does not spontaneously wet with water and maintains a contact angle with water (and other liquids having higher surface tensions) of 90° or less contact angles.

It has been noted that, in the fabric of the present invention, surprisingly wicking yarn/yarn fibres with a high surface energy, for example a polyamide yarn/yarn fibres with a hydrophilic additive/coating/finish, resist the migration of fluorocarbons. This has found to be particularly so during washing of the fabric and a polyamide yarn having a hydrophilic additive/coating/finish resisted migration of a fluorocarbons to a greater extent than polyester microfibres or a polyester/polyamide wicking fibre without a hydrophilic additive/coating/finish, such as Coolmax, which has a lower surface energy. Even though a polyester microfibre has physical properties to allow it to wick particularly well, due to 'wicking channels between the fibres via capillary action,' its fibres has a low surface energy and are hydrophobic. When a polyamide/polyester, for example, has a chemical treatment to it, ie a hydrophilic additive, to increase its surface energy, this will allow the yarn to keep its wicking properties when in contact with fluorocarbon yarns, after being washed in water. The hydrophilic additive/coating/finish applied to the yarn/yarn fibres prevents the fluorocarbons being attracted to it in the washing cycle. Hydrophilic additives, coatings and finishes are known to those skilled in the art.

Preferably the wicking yarns have a high surface energy. Preferably, the textile layer comprises hydrophobic yarns having a low surface energy. "High surface energy" is defined as a surface energy equal to or greater than about 25 $mJ/m^2$ at about 25° C., as calculated from Fowkes two component approach to solid surface energy. "Low surface energy" is defined less than about 25 $mJ/m^2$ at about 25° C., as calculated from Fowkes two component approach to solid surface energy.

Polyamide yarns/yarn fibres with a hydrophilic additive have been found to maintain their wicking properties for a longer period during normal use of the fabric of the present invention than polyesters with the same hydrophilic additive when combined with fluorocarbon yarns/yarn fibres. This is believed to be because intrinsically polyamides, such as Nylon, have a higher surface energy than polyesters. It has also been surprisingly found that wicking yarns, such as cotton, do not need a hydrophilic additive to increase their surface energy, since cotton is intrinsically hydrophilic, once the yarn has been scoured, in order to remove waxes and oils. Preferably, the yarns of the textile layer comprise yarns treated with a fluorocarbon finish and the wicking means comprises wicking fibres or yarns comprising cotton.

Preferably the textile layer comprises yarns having hydrophobic molecular moieties bound to the individual yarns and/or yarn fibres. A yarn may be defined as "a continuous twisting strand of natural or synthetic fibres" (Collins Concise Dictionary, 2001 edition). In order to distinguish fibres which may be used as a wicking means and the fibres which may constitute the yarns, 'yarn fibres' will refer from hereon to those that constitute at least part of a yarn. Preferably, the yarns comprise the yarn fibres as herein described. Typically, a yarn will comprise many yarn fibres. If the yarns comprise yarn fibres, the hydrophobic moieties may be bound to the yarn fibres. The hydrophobic moieties may be bound to the outer fibres of the yarn, those parts of the fibres that form the outer surface of the yarn, or distributed among fibres that are present on both the interior and exterior (outer surface) of the yarn.

Preferably, the molecular moieties are also oleophobic. When a fabric is made from the yarns bound to oleophobic molecular moieties, the fabric will preferably be oil-resistant.

Preferably, the hydrophobic molecular moieties constitute molecules that are directly or indirectly non-covalently bound to the yarns and/or yarn fibres. This may be means of hydrogen-bonding, metal coordination, van der Waals forces, or other non-covalent bonding interaction. An example of non-covalent binding of hydrophobic molecules to a fabric by metal coordination is exemplified in WO0118305. This document discloses production of a breathable fabric by a treatment preparation comprising, in solution, emulsion or suspension (a) a fluorinated polymer that contains reactive groups that can complex with metal atoms that have a formal charge of 2 or greater and (b) one or more metal atoms that have a formal charge of 2 or greater. The fluorinated monomers, oligomers or macromonomers that may constitute the fluorinated polymer are selected from those groups that will provide the necessary water/soil/oil resistance and can be polymerized. Examples include fluorinated monomers of acrylates, methacrylates, alkenes, alkenyl ethers, styrenes, and the like. Monomers that contain carbon-fluorine bonds that would be useful in this invention include, but are not limited to, Zonyl TA-N (an acrylate from DuPont), Zonyl TM (a methacrylate from DuPont), FX-13 (an acrylate from 3M), and FX-14 (a methacrylate from 3M). The fluoropolymers may include $—CF_3$ and $—CHF_2$ end groups, perfluoroisopropoxy groups ($—OCF(CF_3)_2$), 3,3,3-trifluoropropyl groups, and the like. The polymers may include vinyl ethers having perfluorinated or partially fluorinated alkyl chains. The fluoropolymer preferably comprises one or more fluoroaliphatic radical-containing monomers having the structure of Formula I, below:

$$R\text{-}(A)\text{-}(CH_2)_o—(O)_n—(CH_2)_m—X \qquad \text{Formula I}$$

In the compound of Formula I, for example:

m is 0 to 2;

n is 0 or 1;

o is 1 or 2;

A is $—SO_2—$, $—N(W)—SO_2—$, —CONH—, $—CH_2—$, or $—CF_2$;

R is a linear, branched, or cyclic fully- or partially-fluorinated hydrocarbon more preferably a $C_1$ to $C_{10}$, linear alkyl, fully fluorinated, fluorocarbon;

W is hydrogen or $C_1$-$C_4$ lower alkyl; and

X is acrylate ($H_2C{=}CHCO_2$—), methacrylate ($H_2C{=}C(CH_3)CO_2$—), or a carbon-carbon double bond ($H_2C{=}CH$—).

Particularly useful fluorinated monomers are acrylate and methacrylate monomers with the structures $H_2C{=}CHC0_2CH_2CH_2(CF_2)_nF$ and $H_2C{=}C(CH_3)_nCO_2CH_2CH_2(CF_2)_nF$, where n in both cases is 1 to 20. More preferably n lies between approximately 5 and 12, although most commercially available monomers contain a distribution of chain lengths and a few of them may fall outside of this range.

The hydrophobic molecular moieties may comprise hydrophobic polymeric hydrocarbon groups. Preferably, the hydrophobic polymeric hydrocarbon groups are fluorinated.

Preferably the hydrophobic molecular moieties are chemical groups that are directly or indirectly covalently bonded to the surface of the yarns and/or yarn fibres. These chemical groups may comprise one or more monomers, or polymers obtainable by the polymerisation of monomers, of the formula:

$$R\text{-}(A)\text{-}(CH_2)_o\text{—}(O)_n\text{—}(CH_2)_m\text{—}X \qquad \text{Formula I,}$$

wherein:

m is 0 to 2;

n is 0 or 1;

o is 1 or 2;

A is —$SO_2$—, —N(W)—$SO_2$—, —CONH—, —$CH_2$—, or —$CF_2$—;

R is a linear, branched, or cyclic fully- or partially-fluorinated hydrocarbon, preferably a $C_1$ to $C_{30}$, more preferably $C_1$ to $C_{10}$, linear alkyl, fully fluorinated, fluorocarbon;

W is hydrogen or $C_1$-$C_4$ lower alkyl; and

X is acrylate ($H_2C{=}CHCO_2$—), methacrylate ($H_2C{=}C(CH_3)CO_2$—), or a carbon-carbon double bond ($H_2C{=}CH$—).

Suitable hydrophobic polymers that may be covalently bound to yarns/yarn fibres for use in, or present in, a textile fabric are disclosed in WO0118303, WO153366 and US 2002/0155771. WO118303 discloses preparations that comprise a carboxylate-functionalized fluorinated polymer and a catalyst that is capable of forming reactive anhydride rings between carboxyl groups on the polymer. The resulting reactive anhydride rings bind to substrates, such as textiles and other webs. Preferably the polymer comprises a monomer of the Formula I above, with the constituents of Formula I being as defined above. The carboxylate-functionalized fluorinated polymer may be a block copolymer containing i) one or more blocks of acrylic acid, methacrylic acid, maleic anhydride, maleic acid, crotonic acid, itaconic acid, or other acid-containing monomers and ii) one or more blocks of a fluorinated monomer that is capable of binding to cotton or other textiles that contain hydroxyl, sulfhydryl, amine or amide groups in the presence of an anhydride-forming catalyst. Monomers that contain carbon-fluorine bonds that would be useful in this invention include, but are not limited to, Zonyl TA-N (an acrylate from DuPont), Zonyl TM (a methacrylate from DuPont), FX-13 (an acrylate from 3M), and FX-14 (a methacrylate from 3M). The fluoropolymers may include —$CF_3$ and —$CHF_2$ end groups, perfluoroisopropoxy groups (—$OCF(CF_3)_2$), 3,3,3-trifluoropropyl groups, and the like. Particularly useful fluorinated monomers are acrylate and methacrylate monomers with the structures $H_2C{=}CHCO_2CH_2CH_2(CF_2)_nF$ and $H_2C{=}C(CH_3)CO_2CH_2CH_2(CF_2)_nF$, where n in both cases is 1 to 20. More preferably n lies between approximately 5 and 12, although most commercially available monomers contain a distribution of chain lengths and a few of them may fall outside of this range.

In addition, the fluoropolymer will contain two or more reactive carboxyl groups, at least two of them positioned such that they could form a 5- or 6-membered anhydride ring under appropriate conditions and in the presence of a catalyst that will act to create reactive anhydrides from the adjacent carboxyl groups. For example, the reactive monomers may be selected from groups that contain carboxylates such as acrylic acid, methacrylic acid, bisacrylamidoacetic acid, 3-butene-1, 2,3-tricarboxylic acid, maleic acid, 2-carboxyethyl acrylate, itaconic acid, 4-vinylbenzoic acid, and the like. Particularly useful monomers, oligomers, or polymers are those that have carboxyl-containing monomers copolymerized with at least some fluorinated monomers or polymers. One or more surfactants may be present during the polymerization and with the dissolved or suspended polymer.

Anhydride-forming catalysts include, but are not limited to, alkali metal hypophosphites, alkali metal phosphites, alkali metal polyphosphates, and alkali metal dihydrogen phosphates. Some examples of such catalysts are $NaH_2PO_2$, $H_3PO_2$, $Na_3P0_4$, $Na_2HPO_4$, $NaH_2PO_4$, and $H_3PO_4$.

WO0153366 discloses a copolymer that may be bound to yarns/yarn fibres of fabric to impart hydrophobic quality to the fabric. The copolymer comprises a) a fluoroaliphatic radical-containing agent, (b) stearyl(meth)acrylate; (c) a chlorine containing compound, such as vinylidene chloride, vinyl chloride, 2-chloroethylacrylate, or 2-chloroethyl vinyl ether; and (d) a monomer selected from those containing an anhydride functional group or capable of forming an anhydride functional group. The copolymer may be further copolymerized with i) hydroxyalkyl(meth)acrylate to increase the performance and permanency of the resulting copolymer, ii) a compound such as poly(ethylene glycol) (meth)acrylate to improve solubility of the copolymer in water, and/or iii) a chain terminator, such as dodecanethiol, mercaptosuccinic acid, or other similar compounds, which acts to keep the molecular weight of the polymer low so that it is more readily dispersible in water and can better penetrate the fabric. The copolymer can be bound to the yarns/yarn fibres of a fabric by contacting the copolymer, the yarns/yarn fibres of a fabric in the presence of a catalyst for forming anhydrides, such as sodium hypophosphite or those mentioned above, from the acid-containing monomers in the copolymer.

US 2002/0155771 discloses a method of modifying a textile material, the method comprising attaching a multifunctional polymer to the material, wherein the multifunctional polymer comprises hydrophobic groups and hydrophilic groups. Polymerised hydrophobic monomers may constitute at least part of (the hydrophobic) groups. The hydrophobic monomers may be selected from, but not limited to, N-(tert-butyl)acrylamide, n-decyl acrylamide, n-decyl methacrylate, N-dodecylmethacrylamide, 2-ethylhexyl acrylate, 1-hexadecyl methacrylate, n-myristyl acrylate, N-(n-octadecyl)acrylamide, n-octadecyltriethoxysilane, N-tert-octylacrylate, stearyl acrylate, stearyl methacrylate, vinyl laurate, vinyl stearate, fluoroacrylates, and fluorostyrenes, and tetrafluoroethylene. Polymerised hydrophilic monomer may constitute at least part of the hydrophilic groups. The hydrophilic monomers may be selected from, but not limited to, acrylamide, acrylic acid, N-acryloyltris(hydroxymethyl)methylamine, bisacrylamidoacetic acid, glycerol mono(meth)acrylate, 4-hydroxybutyl methacrylate, 2-hydroxyethyl acrylate, 2-hydroxyethyl methacrylate (glycol methacrylate), N-(2hydroxypropyl)methacrylamide, N-methacryloyltris(hydroxymethyl)methylamine, N-methylmethacrylamide, poly (ethyleneglycol)(n)-monomethacrylate, poly(ethylene glycol)(n) monomethyl ether monomethacrylate, 2-sulfoethyl methacrylate, 1,1,1-trimethylolpropane monoallyl ether, N-vinyl-2-pyrrolidone (1-vinyl-2-pyrrolidinone), and 2-hydroxyethylmethacrylate. Preferably the multifunctional polymers comprises a reactive group, such as, for example, poly (maleic anhydride) polymer. Other reactive groups include, but are not limited to, amine, hydroxyl, carboxyl, amide, beta-ketoester, aldehyde, anhydride, acyl chloride, carboxylic acid hydrazide, oxirane, isocyanate, or methylolamide groups. The polymers may comprise a plurality of reactive groups.

A further method of producing a breathable textile layer for use in the present invention is to treat or coat the yarns and/or yarn fibres with a fluorinated hydrocarbon such as polyfluoroethylene, or Teflon®, or teflon-based materials. The treatment/coating is applied to individual fibres/yarns either before or after they have been made into a textile layer. Such a treated textile is available from DuPont. Recently DuPont have released an advanced Teflon Stain Protection which is a durable fluorochemical finish which forms a hydrophobic coating around each yarn and/or yarn fibre, rather than a coating across the whole fabric surface. As a result, liquids bead up and roll off the fabric.

Teflon may be applied by pad, vacuum, foam, kiss coat, coating, or exhaust (yarn to garment finishing is possible) techniques. The pad process is the most common: the fabric is immersed in a water bath containing a Zonyl/Oleophobal product; the excess is squeezed out; and then the fabric travels through an oven to dry and cure the finished fabric.

This new Teflon is applied to the fibre or yarn surface. Heat is applied which melts and spreads the polymers around the fibre surface. It appears that fluorocarbon side chains are oriented away from the surface.

The resultant Teflon-treated fabric of a particular material such as cotton has a feel, drape and handle that is very similar to an untreated fabric of the same material. This advanced Teflon is different to previous treatments as it attaches itself to the individual fibres.

WO2004035909 also discloses a method of producing a breathable textile for use in the present invention. The method involves applying a protective composition, preferably comprising a fluorochemical, to a fabric article, shaping, curing and then cooling the article.

As mentioned above, a wicking means is disposed on the interior side of the textile layer. Preferably the wicking means includes, but is not limited to, wicking (hydrophilic) molecules/chemical groups, which may be bound to the interior side of the textile layer/yarns, wicking substance, structure (i.e. it could have a 'cross shape' which improves wickability), wicking channels or wicking fibres or wicking yarns, or a combination thereof. Wicking substances and hydrophilic finishes include polysiloxanes or hydrophilic molecules/material attached to the yarns of the fabric or yarn fibres. WO 03097925 discloses wicking polymers, suitable for use as hydrophilic finishes, which contain carboxyl groups, salts of carboxyl groups, or moieties that can be converted to carboxyl groups. WO 02059413 discloses protein sheaths, suitable for use as hydrophilic finishes, which may be covalently bound to individual yarns to increase the hydrophilic nature of a fabric. Other suitable fabrics with wicking qualities include NanoDry made by NanoTex, and a fabric called "spacemaster" from Kuraray, the fibres of which have a 'cross shape, which improves the fibre's wicking properties or yarns/yarn fibres with wicking finishes, such as Meryl Nateo, a hydrophilic polyamide yarn supplied by Nylstar.

Preferably the wicking means, which may be wicking fibres or wicking yarns, comprise polyester or polyamide, preferably in an amount of more than 90% by weight, more preferably more than 95% by weight.

Preferably, if the wicking yarn is rendered hydrophilic, ie by applying a wicking additive/finish to it, this process is preferably done before the weaving or knitting process. It is possible however for the hydrophilic additive/finish to be applied during the fabric finishing stages or at garment stages.

The wicking fibres may comprise one or more of: polyester, nylon, polyamides, polypropylene, hydrophobic synthetic fibres, hydrophilic synthetic fibres, hydrophilic and/or cellulosic man made fibres (viscose, modal) and natural hydrophilic fibres such as cotton. The wicking fibres may be cellulosic fibres. The wicking yarns/yarn fibres may be a bicomponent yarn/yarn fibres.

The wicking fibres may constitute part or all of a blended yarn containing two or more different fibres intimately combined, eg. cotton and polyester. The wicking fibres may be intrinsically hydrophilic or have a hydrophilic additive. The wicking fibres may be absorbing fibres.

Preferably if the wicking yarns are cotton fibres, the yarns are preferably thin. Preferably the cotton yarns have a metric cotton count of Nm 10/1, more preferably Nm 20/1, more preferably Nm 30/1, more preferably Nm 40/1 and most preferably Nm 50/1. The terminology of cotton counts X/N is used to indicate the metric cotton count (X) and the ply of the yarn (N). Cotton fibres have been found to be advantageous in that, if the yarns of the textile layer have been treated with a hydrophobic finish (e.g. a fluorocarbon finish), the finish does not significantly migrate to the cotton and detrimentally affect the cotton's wicking properties.

The wicking yarns may be two ply cotton, in order to improve the weaving process. Again, if cotton is used, the yarns should be thin. Preferably the cotton yarns should be Nm 20/2, preferably Nm 32/2, preferably Nm 40/2, preferably Nm 50/2, preferably Nm 60/2, preferably Nm 70/2, preferably Nm 80/2 and most preferably Nm 100/2.

Preferably the wicking yarns have been combed. Preferably the cotton is made from long, fine fibres such as Egyptian Cotton or Sea Island Cotton. Medium fines and medium staple length is also very effective, as in the case of American cotton.

Preferably, the wicking means comprises wicking fibres and these wicking fibres are irremovably attached to the textile layer.

Preferably the wicking means are wicking yarns or fibres, which are integrally knitted or woven with the yarns, preferably hydrophobic yarns, of the textile layer. These wicking yarns or fibres have been found to be better at drawing moisture away from the skin than a yarns treated to a mechanical treatment, such as calendering. Preferably, if a drop of water is dropped onto the wicking surface of the fabric of the present invention (the surface on which the wicking means are disposed), the drop of water spreads out over the surrounding surface area of the fabric preferably within 10 seconds, more preferably within 8 seconds, more preferably within 7 seconds, more preferably within 6 seconds, more preferably within 5 seconds, more preferably within 4 seconds, more preferably within 3 seconds, more preferably within 2 seconds, and most preferably within 1 second.

The wicking fibres/yarns may be integrally woven or knitted with the (preferably hydrophobic) yarns of the textile layer. The fabric may be a double weave fabric. A double weave fabric may defined as: "a compound woven fabric where two sets of warp yarns and weft yarns allow the face and back fabrics to show different patterns or have different properties". One set of warp and weft yarns preferably comprises hydrophobic yarns and the other set or yarns preferably comprises wicking yarns. In a double weave fabric, the fabric has two fabric layers and some yarns from one fabric layer interlace with the other fabric layer so that the fabrics layers are held together. Alternatively, a third, finer, hidden warp interlaces with both fabrics binding them together.

The fabric may be a double-weave fabric or a double-knit fabric. Alternatively a third, finer, hidden yarn is integrally woven or knitted with both fabrics/yarns binding them together.

FIGS. 1 and 2 show two possible weave constructions of the present invention. An embodiment of the present invention is a fabric that comprises two sets of 'upper' hydrophobic yarns (upper warp and weft yarns) that have been knitted or woven together with two sets of 'lower' wicking fibres or wicking yarns (lower warp and weft yarns). The 'upper' side of the fabric would largely comprise hydrophobic yarns and the 'lower' side of the fabric would largely comprise wicking yarns (see FIGS. 1 and 2). It is possible to weave such a fabric so that no wicking yarns are present on the outer layer. To achieve the weave between the two layers, a stitch is formed, however this stitch is not visible on the face of the garment due to a tightly woven structure or due to the upper yarns covering the stitch. An example of such a 'hidden stitch' (5) is shown in FIG. 1. If the yarns of the outer layer have a larger diameter than those of the wicking fibres/yarns, then the wicking fibres/yarns will be substantially hidden from view.

In order to improve the handle, the durability and effectiveness of the fabric, it has been noted that integrally weaving or knitting the yarns of the textile layer with the wicking yarns gives a better result than laminating the two separate layers together. The fabric unexpectedly still prevents liquid passing through the fabric (and hence sweat marks will not show on the fabric), while allowing vapour to pass through (and hence the wearer of the fabric will remain cool).

The yarns of the textile layer and the wicking yarns may be knitted together to give a two-faced knitted fabric whereby one side of the fabric has water/stain repellent properties and the other side has wicking properties.

The knitted structure may be a double-knit structure. The yarns of the textile layer, preferably hydrophobic yarns, and wicking yarns/fibres are preferably linked together so there are very few or no pockets of air in the fabric. Preferably at least 30% of hydrophobic yarns and wicking yarns are linked together, more preferably 40%, more preferably 50%, more preferably 60%, more preferably 70%, more preferably 80%, more preferably 90% and most preferably 100%. Preferably there are many intersections and knitted stitches between the hydrophobic yarns and wicking yarns, and preferably the intersections and knitted stitches extend substantially over the entire body of the fabric, as opposed to, for instance, only around the outside edge of the fabric.

The side of the fabric on which the wicking yarns are disposed preferably has a raised effect. The fabric of the present invention may comprise hydrophobic yarns and wicking yarns or fibres, and the fabric may have a double-knit structure selected from, for example: a double jersey jacquard, double pique, or double twill knits, or double jersey or birds eye knit or interlock or piquette. Preferably, the wicking yarns, or the majority of the lengths of the wicking yarns, are disposed on one side of the fabric, preferably the side of the fabric with the most raised surface texture.

Preferably the outer face of the fabric will have at least 50% hydrophobic yarns exposed, more preferably at least 60%, more preferably at least 70%, more preferably at least 80%, more preferably at least 90% and most preferably about 100%.

The fabric of the present invention may have a knitted structure, which may be a single-knit fabric with two different faces, one face with hydrophobic properties, the other with hydrophilic properties. The outer face is mostly or entirely made up of the hydrophobic yarns and the inner yarn is or has been rendered hydrophilic or has wicking properties. The fabric of the present invention may comprise hydrophobic yarns and wicking yarns or fibres, and the fabric may have a single-knit structure selected from: single pique knits, jacquard knits, interlock jersey, rib knit, interlock, twill knits or birds eye knit. Preferably, in the single-knit fabrics there are many intersections or interlocks between the yarns on the inner (wicking) face and outer (hydrophobic) face, with few or no pockets of air in the fabric. Preferably, the side of the fabric, on which the wicking yarns are disposed has a raised effect. For example, if the fabric has a single pique knit structure, preferably the wicking yarns will be on the face where there is the pique effect. The side of the fabric having this pique effect is preferably worn next to the skin, if the fabric is formed into or forms part of a garment.

In order to make a lighter fabric, the fabric may have a third yarn (which may be the same as one of the fibres of the textile layer or wicking fibres or may be different) which acts as binder. In this case, the hydrophobic yarns and the wicking yarns are not knitted together but are linked together by the integrally knitted third yarn. This will give a thin fabric, which has two faces with different yarns/yarn properties (i.e. the intended inner side of the fabric comprising wicking fibres/yarns (ie polyester or cotton), and intended outer side of the fabric comprising hydrophobic yarns.)

Another way of producing a knit fabric of the present invention is by 3-D knitting, i.e. by forming a fabric having a two layers: a first knitted layer comprising hydrophobic yarns/fibres and a second knitted layer comprising wicking yarns and fibres, wherein the first and second layers are connected by an integrally knitted third yarn. If a third yarn is introduced which links the hydrophobic yarns with the wicking yarns to form a fabric, preferably the majority of the hydrophobic and wicking yarns are integrally linked together. This construction is in preference to simply sewing a knitted fabric layer comprising hydrophobic yarns to a knitted fabric layer comprising wicking yarns with regularly spaced lines of stitches. The inner and outer yarns are preferably linked together so there are very few or no pockets of air in the fabric. Preferably at least 30% of hydrophobic yarns and wicking yarns are linked together, more preferably 40%, more preferably 50%, more preferably 60%, more preferably 70%, more preferably 80%, more preferably 90% and most preferably 100%. The wicking fibres could also be introduced into the knit structure as float stitch or float loop.

A double-weave fabric may be a relatively thick fabric, which may be inappropriate for light weight garments, such as summer shirts. Single-weave fabrics have the advantages over double-weave fabrics of being lighter, softer, allow more vapour through and have a better drape and handle. Ideally, a garment made from a fabric of the present invention feels similar, if not identical, to a garment made from a normal single-weave fabric that is penetrable to both liquid water and water vapour, such as a cotton shirt. Preferably, the fabric of the present invention is a single weave fabric, which has a similar drape and handle to traditional prior art single weave fabrics. It would be advantageous to develop a single-weave fabric with which does not have any surface treatment over the entire fabric layer but instead a treatment has been applied to the yarns/yarn fibres. This in turn would not only improve the handle of the garment as the treatment is on the individual yarns rather than the fabric surface, but also it will improve its ability to allow vapour through the fabric, as there will be gaps between the yarns. In fabric surface treatments, the chemical finish/emulsion tends to cover the gaps between the yarns and in turn reduces breathability.

A single-weave fabric which has the water/stain repellent properties on one side and wicking properties on the other has been achieved by weaving a single-layer fabric using hydrophobic yarns and wicking yarns/yarn fibres. The majority of the lengths of the these wicking yarns/fibres are preferably disposed on one side of the fabric, i.e. the intended inner side of the fabric.

Wicking yarns/yarn fibres are preferably present on one surface as 'floating yarns/yarn fibres.' It may be a weft float, which may be as defined by The Anstey Weston Guide to Textile Terms as "a length of weft yarn on the back or surface of the cloth that is between intersections." An intersection is a point at which two other yarns cross in the fabric. Generally, a floating weft yarn will pass over two or more warp yarns between points at which it passes under warp yarns. It may be a warp float, which may be as defined by The Anstey Weston Guide to Textile Terms as "a length of warp yarn on the back or surface of the cloth that is between intersections." Generally, a floating warp yarn will pass over two or more weft yarns between points at which it passes under weft yarns. These floating wicking yarns are preferably attached to the hydrophobic yarns, but largely only visible on one surface (the surface which is wicking, i.e. the intended inner surface of the fabric).

In an alternative embodiment, the fabric of the present invention may comprise a textile layer comprising wicking yarns or fibres, wherein disposed on one side of which are hydrophobic yarns. These hydrophobic yarns may be integrally woven or knitted with the hydrophilic yarns of the textile layer. The fabric may comprise wicking warp and weft yarns and integrally woven floating hydrophobic yarns.

A single woven fabric which is double faced (i.e. each face having different properties), with warp/weft floating wicking yarns/fibres on at least one side would be advantageous, as this would give the desired performance yet not compromise the natural handle and drape of the fabric. This single woven fabric would therefore have one face exhibiting hydrophobic properties and the other hydrophilic properties. The fabric has been found to have a surprisingly similar feel as an untreated fabric.

The yarns on the outer side of the fabric may have a tighter weave structure than the wicking yarns/fibres on the inner side of the fabric. This is advantageous in that the majority of the wicking yarns are then present on the intended on the inner surface and few, if any, are present on the intended out surface of the fabric. The wicking fibres are blended together with the fibres/yarns of the textile layer. FIGS. 5A to 5C illustrate the intended inner (wicking) layer of various single-weave fabrics of the present invention. FIG. 5D illustrates the intended inner (wicking) layer of an example double-weave fabric of the present invention. In these figures, the white yarns are the wicking fibres. The intended outer face of the fabric in each figure, if it could be viewed, would show approximately 100% hydrophobic yarns.

It may be possible to get the desired effects by having a single satin and/or sateen woven fabric comprising the outer hydrophobic yarns and inner wicking yarns, for example on one face there are 75% or more of hydrophobic yarns and on the other face are 75% or more of wicking yarns. A sateen fabric is a woven structure where the maximum amount of weft shows on the face. A satin fabric is a woven structure where the maximum amount of warp shows on the face.

The wicking means may comprises low denier wicking fibres that form a layer and this layer may be adhered to the textile layer. The adhesion may be achieved by using any one of liquid adhesives, flame lamination or powder adhesive, film, web adhesive, chemical glue or a mixture thereof. Alternatively, the low denier fibres may form a layer that is mechanically joined to the textile layer. "Mechanically joined" includes, but is not limited to, weaving, knitting or sewing the two layers together. The mechanical joining means, such as stitches, may be distributed at regular intervals across the fabric or at a seam when part of a garment.

If adhered with adhesive, the adhesive is preferably distributed in spot locations between the layers and is not uniformly distributed over the entire surface of the interface between the layers. The adhesive may be breathable. Breathable adhesives include, but are not limited to those comprising polyester, polyamide, polyethylene. Preferably the adhesive comprises, as an additive, a sanitary agent as described herein.

Preferably, the wicking means forms a layer on the interior side of the textile fabric. Preferably, the wicking means comprises wicking fibres and said wicking fibres form a layer.

Preferably, the wicking fibres are non woven, woven or knitted fibres and form a layer. It has been found that knitted wicking fibres, particularly those of low denier, preferably microfibres, have a softer feel than nonwoven wicking fibres.

If the wicking means, for instance wicking fibres, forms a layer, preferably the weight of the layer is 300 gsm or less, preferably 250 gsm or less, preferably 200 gsm or less, preferably 180 gsm or less, preferably 150 gsm or less, preferably 120 gsm or less, preferably 100 gsm or less, preferably 80 gsm or less, preferably 60 gsm or less, preferably 70 gsm or less, preferably 50 gsm or less, preferably 30 gsm or less, preferably 10 gsm or less. It has been found that when the wicking layer is under 80 gsm, this significantly improves the handle of the overall fabric.

Preferably, if the wicking means comprises wicking yarns/yarn fibres and these are woven or knitted as part of the textile layer, the entire fabric is a low weight fabric. Low weight includes, but is not limited to, less than 300 gsm, less than 250 gsm, less than 200 gsm, less than 185 gsm, less than 175 gsm, less than 150 gsm, less than 130 gsm, less than 120 gsm, less than 110 gsm, less than 100 gsm, less than 90 gsm, less than 80 gsm and most preferably less than 70 gsm.

It has been found out that a shirt comprising a fabric of the present invention is most comfortable when the fabric has a weight equal to or less than 300 gsm, preferably 250 gsm, more preferably 200 gsm more preferably less than 140 gsm, more preferably 130 gsm, even more preferably less than 120 gsm, and most preferably less than 115 gsm.

Likewise pique tops, sportswear tops and t-shirts preferably comprises a fabric of the present invention with a weight of less than 300 gsm, preferably less than 250 gsm, preferably less than 200 gsm, more preferably less than 150 gsm, more preferably less than 140 gsm, more preferably 130 gsm, even more preferably less than 120 gsm, more preferably less than 115 gsm, more preferably less than 110 gsm and most preferably less than 100 gsm.

The fabric may be dyed either at yarn level or at fabric level. If it is dyed at yarn level, this is usually treated before or simultaneously with the stain and/or water repellent finish, if applied. If it is dyed at fabric level, preferably the outer hydrophobic yarn, particularly if it is cotton, has not yet been fixed with the stain and/or water repellent finish.

The fabric may be dyed at fabric level after it has been woven or knitted. For polyester fabrics, it is possible to dye a fluorocarbon fabric at the standard temperature of about 120° C. or above. For cotton fluorocarbon fabrics, a dyeing temperature of 40° C.-50° C. is not sufficient to dye the fabric as the fluorocarbons repel the dye. It is therefore necessary to increase the dyeing temperature to about 70° C.-80° C. in order for the dye to penetrate the fluorocarbons with the dye and heat and allow the dye to fix to the cotton fibres.

The handle and performance of the fabric of the present invention was found not to be affected by dyeing in the above manner.

The textile layer may be printed. Fluorocarbon-treated cotton and polyester fabrics were applied with standard industry pigment dyes and then cured in an oven for 3 minutes at 150° C. The pigment dyes were found to bind successfully to both fabrics and did not affect either their fabric handled or performance. As the print pigmentation binds to the outer face of the fabric, the print does not therefore affect the wicking yarn's performance.

As mentioned above, the wicking means may comprise low denier fibres, preferably microfibres. The wicking means may comprise nanofibres. Preferably, the wicking means comprise microfibres and nanofibres. These wicking means/wicking fibres preferably comprise polyester, acrylic, or polyamide. These fibres may form a layer. The wicking means/fibres may comprise cotton or another type of hydrophilic fibre, preferably a fibre having a high surface energy, as defined above.

Denier is a measure of the linear density of a fibre or yarn. "Low denier" includes, but is not limited to, a denier of 15 or lower, more preferably 11 denier or lower, even more preferably 5 denier or lower, still more preferably 3 denier, most preferably lower than 2 denier, more preferably 1.8 denier or lower, more preferably 1.5 denier or lower, most preferably 1.2 denier or lower.

A microfibre is a low denier fibre that has linear density of 1 denier per filament (dpf) or less. Preferably the microfibres have a denier less than 1, more preferably 0.5 or less, more preferably a denier of less than 0.05, most preferably a denier of from 0.005 to 0.05. It has been found that a clothing article in which the second layer comprises low denier fibres, particularly microfibres, is significantly better than the articles of the prior art at wicking moisture away from the skin of a wearer. Preferably the wicking means forms a layer and comprises more than 50% by weight, low denier fibres, more preferably more than 80% by weight, low denier fibres, most preferably more than 95% by weight, low denier fibres.

Microfibres, also known as "microdenier fibres", can have silk-like properties, including the drape, flow, look, feel, movement, softness and luxuriousness of silk, which make the microfibres desirable in the fashion industry for making items such as intimate apparel, outerwear, and sportswear. Although similar to silk, synthetic microfibres also have the useful properties and performance imparted to and in common with certain man-made fibres. For example, synthetic microfibres, such as those of polyester, tend to be easy to care for and often have "wash & wear" capability. An advantage of using a layer of wicking microfibres in fabric of the present invention is that this layer is able to prolong the life of the water repellency of the textile layer due to the separation of the textile layer from the skin of a wearer and hence reduced frictional contact of the textile layer with a wearer's skin and perspiration. This is particularly so if the microfibres are very finely woven or knitted. Low denier fibres, including microfibres and nanofibres, are significantly better than any other fibre in spreading the perspiration over a large surface area, and hence increase the rate of evaporation of the perspiration.

Recent developments in the science of nanotechnology and polymer extrusion has resulted in the production of nanofibres. A nanofibre is preferably a single molecule fibre in filament form. Nanofibres may be defined as fibres having a diameters of 1000 nm or less. Preferably, they have a diameter of from 3 nm to 1000 nm. This is in general much finer than microfibres. Carbon-based nanofibres can have a tensile strength several hundred times that of steel. The technology of making nanofibres has been developed in a project sponsored by the National Textile Centre of USA. University of Manchester Institute of Science and Technology has also developed this technology on experimental equipment. The manufacturing technology makes use of combination of electrostatic and mechanical forces to extrude the fibbers. The process has been described as "Electro-spinning". In this process a liquid in a tube is subjected to a high voltage, the electrical forces overcome surface tension and the liquid is extruded out in jets, which splits into an array of finer and finer filaments.

Unlike conventional fibre spinning techniques, which are also capable of producing polymer fibres with diameters down to the micrometer range, electrostatic spinning seems to be fast and simple. Scientists engaged in these developments are of the opinion that nanofibres can be made easily from any polymer, which can be dissolved in a volatile solvent, and can also be made from molten polymers. Preferably, the nanofibre filaments are from 50 to 100 nanometres in diameter and 50 to 200 microns long.

Nanofibres are particularly advantageous for use in clothing as a wicking means because of their low density and high surface area of these fibres. Preferably the nanofibres comprise polyester or polyamides.

The textile layer and/or the wicking means may comprises one or more sanitary agent. Preferably, one or more sanitary agents are disposed on the interior side of the textile layer, preferably in a wicking layer or in the wicking yarn. The sanitary agent may be a substance, fibre or yarn. The sanitary agent may be evenly distributed over the entire interior side of the textile layer. "Sanitary agent" encompasses any sanitising means capable of imparting a sanitary or sanitising characteristic or property, which may be an anti-microbial, biocidal agent, deodorising agent, odour absorbing agent, anti-perspirant agent, insect-repelling agent or fragrance releasing agent, for example.

The sanitary agent may be distributed on the surface of fibres and/or yarns/fabric that constitute the textile layer or fibres that constitute the wicking means, or within the textile yarns/fibres or wicking fibres, or a combination thereof. The sanitary agent/fibres/yarn may be present on the interior of the textile layer or distributed on one or both sides of said layer.

The sanitary agent may comprise an anti-microbial agent. The anti-microbial agent may be a biocidal agent, a biostatic agent or both. The anti-microbial agent is preferably an anti-bacterial agent, an anti-fungal agent or both an anti-bacterial and anti-fungal agent.

Suitable anti-microbial agents include, sulphur-containing compounds and/or nitrogen-containing compounds, and other types of anti-microbial agent known to the skilled person.

Suitable sulphur-containing anti-microbial compounds may include thiocarbamates, thiocyanates, isothiocyanates, dithiocarbamates and mixtures thereof, for example.

Suitable nitrogen-containing anti-microbial compounds may include quaternary ammonium compounds, amides, triazine and guanidines, and mixtures thereof, for example.

The sanitary agent may comprise substances which degrade or bind to ammonia, denatured proteins or lactic acid, or any combination thereof. Suitable substances include silver and silver-containing compounds, copper and copper-containing compounds. Silver includes, but is not limited to, Ag(0) and Ag(I). These may include silver yarns/yarn fibres or coatings/finishes.

A particularly suitable anti-microbial agent is triclosan (2,4,4'-trichloro-2-hydroxydiphenyl ether) or its derivatives.

Alternatively, the anti-microbial agent may be based on metals, such as, silver-containing compounds, tin-containing compounds, copper compounds, glutaraldehyde or an iodophor, for example.

There may be more than one different anti-microbial agents present in the second layer.

The sanitary agent may comprise a deodorising agent.

The deodorising agent may effect deodorising by a chemical odour-neutralising action, a photo-catalytic reaction or both.

The deodorising agent may also be an anti-microbial agent or have anti-microbial activity.

The sanitary agent may comprise an agent capable of encapsulating odour-emitting chemicals. Alternatively the sanitary agent may be in the form of microcapsules per se.

Suitable deodorising agents may include activated carbon, zeolites, inorganic compounds such as silicon metal oxides of titanium ($Ti0_2$), zinc (Zn0) and aluminium, ceramics and ceramic-coated sheath fibres (such as sheath-core biocomponent polyester fibres in which the sheath side includes ceramics).

The odour absorbing agent is preferably selected from cyclodextrins or activated charcoal, or a mixture thereof. Cyclodextrins are known in the art. They are rings of glucose units, and may be produced from starch via enzymatic reaction. The 'hole' in the middle of the ring can large enough to hold many small molecules, and as such, cyclodextrins can act as an encapsulating agent for many applications. e.g. Reduction of unpleasant odour, enhancement of water solubility of a fabric, controlled release of chemicals, e.g. fragrance chemicals.

A way of releasing fragrances could be by applying fragrances to the fabric in microcapsules.

Microencapsulation is a process by which very tiny droplets or particles of liquid or solid material are surrounded or coated with a continuous film of a polymeric material. The contents of the microcapsules can be released in a variety of ways, depending on the characteristics of the capsule wall, including physical pressure, friction, diffusion, wall dissolution and biodegradation. The range of commercial microencapsulation techniques fall into five distinct categories:

a) Spray coating methods e.g. Wurster air suspension coating b) Wall deposition from solution c) Interfacial reaction d) Physical processes e) Matrix solidification A further innovative micro-encapsulation process involves the use of naturally occurring pre-formed capsules (e.g. yeast cells).

Preferably the sanitary agent comprises both an anti-microbial agent and a deodorising agent, or single agent providing both anti-microbial and deodorising properties.

To reinforce the effects of the fabric's water repellency there may be disposed in between the textile layer and the wicking layer a water repellent coating or water repellent film (breathable film) or water repellent fibres or water repellent layer. The inner layer may be water repellent with the interior face of the inner layer having a wicking coating/finish.

The present invention also provides an article of clothing comprising a textile fabric as claimed in any one of the preceding claims. The article may be selected from a shirt, T-shirt, vest, polo top, pullover, male or female brief, underwear, longjohn, nightwear such as pyjamas, sportswear top, bra, cardigan, skirt, dress, blouse, trousers, tracksuit bottom, shorts, sock, tie, pair of jeans, glove, coat, jacket, boxing glove, mitt, hat, cap, skull cap, helmet, dressing gown, baby clothing such as nappies and bibs, garments such as gowns, drapes, overalls, masks, uniforms such as chef's jackets and aprons, and inner lining of clothing and towels. Clothing includes footwear, for example, insoles, shoes, sandals and trainers. The fabric of the present invention may constitute part of or, preferably, all of a garment fabric. For instance, it would be possible to construct trousers, shirts, t-shirts where the fabric of each was the fabric of the present invention. Alternatively, only part of a garment may comprise the fabric of the present invention. For example, a garment such as a t-shirt or shirt, may comprise the fabric of the present invention in locations commonly in contact with perspiration, such as the 'armpits' or back of the garment.

The present invention further comprises a number of methods of making the fabric of the present invention. The textile layer, yarns, wicking means are as described above.

The present invention also provides a method of making a textile fabric of the present invention, obtainable by a process comprising:

providing a textile layer comprising hydrophobic yarns/yarn fibres wherein said textile layer is permeable to water vapour and impermeable to liquid water;

and disposing on the intended interior side of the textile layer a wicking means.

The method may comprise:

providing hydrophobic yarns, forming the yarns into a textile layer, disposing on the intended interior side of the textile layer a wicking means. The wicking means may comprise low denier fibres that are interwoven or knitted with the textile layer. The yarns may comprise hydrophobic yarn fibres.

The method may comprise:

(i) providing yarns for making a clothing fabric, forming the yarns into a textile layer, (ii) disposing on the intended interior side of the textile layer a wicking means, and, before or after step (ii), (iii) treating the yarns of the textile layer to form hydrophobic yarns, such that the resultant textile layer is permeable to water vapour and impermeable to liquid water. The wicking yarns are preferably integrated into the textile layer, in the same process as the textile layer is being woven/knitted. Eg. in the case of a woven fabric, by introducing the wicking yarns/yarn fibres as floating yarns.

The hydrophobic yarns may be obtainable by a process comprising providing a polymer formed from hydrophobic monomers and, optionally, hydrophilic monomers, said monomer further comprising a reactive group capable of forming a covalent bond with hydroxy-groups or amine groups on the surface of a yarn, reacting said polymer with yarns to form hydrophobic yarns.

The hydrophobic monomers may be selected from N-(tert-butyl)acrylamide, n-decyl acrylamide, n-decyl methacrylate, N-dodecylmethacrylamide, 2-ethylhexyl acrylate, 1-hexadecyl methacrylate, n-myristyl acrylate, N-(n-octadecyl)acrylamide, n-octadecyltriethoxysilane, N-tert-octylacrylate, stearyl acrylate, stearyl methacrylate, vinyl laurate, vinyl stearate, fluoroacrylates, fluorostyrenes, and tetrafluoroethylene.

The hydrophilic monomers may be selected from acrylamide, acrylic acid, N-acryloyltris(hydroxymethyl)methylamine, bisacrylamidoacetic acid, glycerol mono(meth)acrylate, 4-hydroxybutyl methacrylate, 2-hydroxyethyl acrylate, 2-hydroxyethyl methacrylate (glycol methacrylate), N-(2hydroxypropyl)methacrylamide, N-methacryloyltris(hydroxymethyl)methylamine, N-methylmethacrylamide, poly (ethyleneglycol)(n)-monomethacrylate, poly(ethylene glycol)(n) monomethyl ether monomethacrylate, 2-sulfoethyl methacrylate, 1,1,1-trimethylolpropane monoallyl ether, N-vinyl-2-pyrrolidone (1-vinyl-2-pyrrolidinone), and 2-hydroxyethylmethacrylate.

The polymer may be a modified poly(maleic anhydride) polymer.

The hydrophobic yarns may be obtainable by contacting yarns with a preparation comprising i) a polymer that contains one or more hydrophobic groups and two or more reactive carboxyl groups, at least two of them positioned such that they may form a 5- or 6-membered anhydride ring; and ii) an anhydride-forming catalyst.

The present invention further provides a method of making an article of clothing comprising providing a textile fabric made using a method of the present invention, forming said article of clothing from said textile fabric, optionally using one or more other fabrics that are permeable to liquid water and water vapour.

The present invention further provides a textile obtainable by a method of making a fabric as herein defined.

The present invention provides an article of clothing obtainable by the method of making an article of clothing as herein defined.

Preferably, the surface tension of the interior side of the textile layer has a surface tension higher than that of water. The exterior side may have a surface tension lower than that of water. Both interior and exterior side may have a surface tension lower than that of water. Preferably the surface tension of the exterior layer is lower than that of oil, preferably vegetable oil.

Preferably, the textile layer is permeable to water vapour and impermeable to liquid water;

said textile layer comprises an interior side, which, in use, faces the intended wearer of the article and an exterior side, which, in use, faces away from the intended wearer of the article; and disposed on at least part of the interior side of the textile layer are wicking fibres. Preferably, said wicking fibres are irremovably attached to the textile layer.

The wicking fibres may be integrally woven or knitted with the yarns of the textile layer.

Preferably, the wicking fibres are irremovably attached with adhesive to the textile layer.

Preferably, the wicking fibres are irremovably woven/knitted with the yarns of the textile layer.

Preferably, the wicking fibres comprise low denier fibres, preferably microfibres, even more preferably nanofibres, or any combination thereof, preferably a combination of microfibres and nanofibres.

Preferably the low denier fibres comprise polyesters or polyamides with a wicking/hydrophilic finish.

The wicking means may form a layer. Preferably said layer comprises low denier fibres, preferably microfibres, even more preferably nanofibres, or any combination thereof, preferably a combination of microfibres and nanofibres.

The wicking fibres may be woven, non-woven or knitted, or meltblown.

The wicking means may not be very water absorbent and wicks moisture away from the body through capillary forces, across a large surface area, through fine fibres (e.g. microfibre). The wicking means may comprise a hydrophobic or hydrophilic substance. Preferably little or no liquid perspiration is absorbed but is actively being wicked away in order to evaporate. If, for example a hydrophilic fibre such as cotton is used as the wicking fibre, preferably the cotton fibre is thin in order to reduce its moisture retain and allow the moisture to spread from one cotton fibre to the next. Preferably, the wicking means comprises cotton fibres or yarns of Nm 10, Nm 15, Nm 20, Nm 25, more preferably Nm 30, more preferably Nm 40 and most preferably Nm 50.

The wicking means may also be a coating/finish/powder applied either to the interior of the textile layer, or to the individual yarns/yarn fibres of the textile layer/or to the inner layer or a material made into a web like structure or a powder or meltblown fibre or a very light knit (similar to that found in ladies tights). Elastane etc may add flexibility to this layer/yarns/yarn fibres. The wicking means may be due to a surface effect such as brushing.

Preferably the textile layer comprises cotton &/or polyester &/or linen &/or silk fibres.

Preferably the entire fabric of the present invention is made up of only two types of yarns—an 'outer' yarn constituting the textile layer and an 'inner' yarn constituting the wicking means (e.g. Nanopel/Nanocare (NanoTex) coated cotton yarn as the outer yarn & Polyester Microfibre yarn or polyester or polyamide yarn with wicking finish (such as Meryl Nateo from Nylstar) or hydrophilic yarn such as cotton as the wicking means.

Both sides of the fabric may comprise microfibres (including polyesters, polyamides etc)

Further preferred embodiments and preferences of the present invention are discussed below. "Inner" is synonymous with "interior". "Outer" is synonymous with "Exterior".

In a preferred embodiment, the present invention provides a breathable fabric comprising or consisting of two layers:

an outer breathable textile layer either having a hydrophobic shield or coating around the individual textile yarns or yarn fibres or in the individual yarns or yarn fibres such that the textile layer is hydrophobic, said textile layer being laminated, attached or sewn to an inner layer which is moisture wicking and/or absorbing.

The hydrophobic shield or coating may be applied at any stage of the fabric production, i.e. either to the yarn fibre, yarn, fabric or garment. The hydrophobic shield or coating may comprise or consist of hydrophobic molecular moieties as defined herein.

The hydrophilic/wicking finish for the wicking means may be applied to the interior of the fabric or to the yarns/yarn fibres at any stage of the fabric production, but preferably before the weaving/knitting process, in order for increased durability.

Preferably the inner layer comprises low denier fibres, more preferably microfibres.

Preferably the inner layer is closely knitted or has a woven structure in order to spread liquid perspiration over a large surface area and to prevent beading of the liquid perspiration against the body. The fewer large gaps in the fabric, the better.

Preferably the inner layer is closely knitted or has a woven structure in order to maximise/protect the fibres of the outer layer's water-repellency and abrasion from perspiration by the body (e.g. the rubbing of sweat under the arm-pit). Preferably, if the inner/wicking yarn is introduced into a woven structure as floating yarns, the yarn covers at least 30% of the intended inner surface, more preferably at least 40%, more preferably at least 50%, more preferably at least 60%, more preferably at least 70%, more preferably at least 80%, more preferably at least 85%, more preferably at least 90%, more preferably at least 95%, and most preferably about 100%. Preferably the floating yarns are close to one another, most preferably touching each other, in order to enhance the wicking effect, by leaving channels for removing moisture by capillary action or by spreading moisture over the surface by the hydrophilic finish added to the yarn/yarn fibres or the intrinsic absorbency of the yarn/yarn fibres.

The inner layer could be a coating or a low denier fibre/microfibre made into a web like structure (similar to that found in ladies tights). Elastane etc may add flexibility/stretch to this layer.

Preferably the inner layer is closely knitted or has a woven structure to reduce odour transmission into the outer fabric.

Preferably the entire fabric has sanitising properties and both layer/yarns comprise one or more sanitary agents as defined herein.

Preferably at least one of the layers/yarns has sanitising properties and comprises one or more sanitary agents/fibres/yarns as defined herein.

Preferably, if adhesive is used to adhere the two layers together, the adhesive is breathable. Preferably the adhesive further comprises one or more sanitary agents as defined herein.

Preferably if the two layers are fabrics and form part or all of a garment, the layers are sewn together, preferably in an even distribution across the layers, rather than just sewn at the garment's seams.

In contrast to other breathable fabrics of the prior art where the outer textile layer is hydrophilic, e.g. using untreated cotton, the textile layer of the present invention does not have an absorbent function in the outer yarn. It instead allows moisture to evaporate through the gaps in and between the yarns. The wicking layer/yarns acts to remove moisture from a wearer's skin, and ideally spread the moisture over a wide surface area to allow it to evaporate quickly through the outer textile layer.

Low denier fibres are used since they are able to give an excellent handle to the resultant fabric. Low denier fibres are able to protect the water repellency applied to the textile yarns from wearing off or degrading, as the structure of microfibres, especially those which are tightly woven, will with-hold the fluorocarbons, for example. Low denier fibres, including microfibres and nanofibres, are significantly better than any other fibre in spreading the perspiration over a large surface area, thus counteracting any type of drop in water repellency of garments after washing. In turn visible perspiration marks will not be visible on the outer fabric.

The low denier fibres preferably comprise acrylic, polyester, polyamide fibres, or any combination thereof. Preferably the low denier fibres are woven, knitted or non woven in construction. Preferably the low denier fibres comprise polyesters, nylons, polyamides, polypropylenes, or any combination thereof.

The inner layer may be a coating/finish which is attached to the textile layer or to the individual yarn fibres or yarns.

Preferably at least one layer has sanitising properties, preferably both layers have sanitising properties.

The breathable adhesive may possess sanitising properties as defined herein and comprise sanitising agents as defined herein.

Preferably the sanitising agents are present on the inner side of the fabric and, in use, contact the skin of a wearer of a garment made from the fabric of the present invention.

Preferably the textile fabric comprises one or more of:

cotton fibres
wool fibres
polyester fibres
polyamide fibres
lycra
spandex
rayon fibres
viscose fibres
rayon fibres
jute fibres
linen fibres
Silk
Elastane
Acrylic
Acetates
hemp
flax
Polyvinyl alcohols
corn fibres
substitute cotton fibres such as bamboo
polypropylenes
microfibres
nanofibres The two layers can be either be laminated (heat, chemical), knitted, woven or sewn together. If the fabric layers are knitted, woven, this should be done at fibre/yarn level, i.e. each layer is integrally knitted or woven, rather than knitting, weaving two pre-produced layers together. Sewing can be done either at fabric stage or at fibre/yarn stage.

Preferably the two layers are permanently attached to one another in order to withstand washing cycles.

Preferably, rather than a two-layer fabric, or a double knit or double woven fabric, the fabric is a single knit or weave which is double-faced, one face comprising the outer hydrophobic yarn & the other face comprising the inner wicking yarn.

Preferably, the garment will be able to withstand ironing and dry cleaning.

Preferably, the outer layer/yarn comprises one or more of:

cotton fibres
polyester fibres
silk fibres
nylon fibres
lycra fibres
microfibres
polyamide fibres
acrylic fibres
silk
elastane
nanofibres wool fibres
polypropylene fibres
viscose fibres
linen fibres Preferably the inner layer comprises fibres which have, in use, a capillary effect, in order to wick away sweat from the body.

Preferably the inner layer/yarn is made from synthetic fibres or hydrophilic natural fibres.

Preferably, the inner layer/yarn comprises one or more of:
cotton fibres
polyester fibres
silk fibres
nylon fibres
lycra fibres
microfibres
polyamide fibres
acrylic fibres
silk
elastane
nanofibres
wool fibres
polypropylene fibres Preferably if the inner yarn is a synthetic fibre, it has a finish on/in it, which renders it hydrophilic, as in the case of the polyamide Meryl Nateo, supplied by Nylstar. Having the inner yarn as a polyamide with wicking finish proved to be excellent at wicking the moisture away from the skin and durable after many washes.

Preferably both layers/yarns are of the same colour or complement one another or the inner having a neutral colour in order that the fabric appears to be either one layer or that a light fabric on the inside is adopted in order that dark sweat patches do not show through from the wicking material.

Preferably, the outer fabric has sanitising properties and/or sanitising agents, fibres, yarns as defined herein.

The fabric of the present invention is ideal for items of clothing which are worn under a heavy coat or jacket, which is not tough and rigid such as shirts, t-shirts, blouses, shorts, trousers, jeans, underwear, dresses, long sleeve tops, jumpers, sweaters, cardigans, skirts, tracksuit trousers, sportswear including items of clothing which have high stretch such as cycling shorts, tight tops, ¾ length trousers etc. In general the fabric is suitable for items of garments which tend to be washed on a regular basis.

The outer layer or inner layer or both layers, may comprise nano fibres, which may be selected to further enhance the water repellency (outer layer) or wicking (inner layer).

If the garment fabric is a shirt, the handle would be enhanced if it had a peachskin finish.

The fabric layer is preferably not a hard or soft shell fabric like in high endurance outerwear, such as hiking jackets but items of clothes for everyday usage.—i.e. cotton shirts and t-shirts Ideally, the outer layer/yarn does not feel like it is heavily coated with a water repellent finish, but has a fabric/yarn handle similar to any other cotton/polyester fabric, for example.

Preferably the fabric construction of the inner layer/yarn matches the outer layer/yarn. For example, if the outer layer is woven, the inner layer would also be woven, although the yarn composition of each layer would be different.

The inner layer is not intended to keep a wearer of the garment warm, but in fact to wick the moisture away from the body, in turn cooling the skin. The inner layer/yarn is preferably not a fleece material but a thin, very lightweight and drapable fabric/yarn.

There may be no slow drying, liquid retaining, cellulosic, absorbent layer interposed between the outer and inner layer/yarn.

Preferably at least one of the layers has either UV absorbers or screening agents.

The fabric may be fire-resistance or flame retardant. The fabric may comprise smoke particle absorbing agents, including, but not limited to cyclodextrins.

The fabric may have anti static properties.

The outer textile fabric/outer yarn may have stain repellent and oil-repellent properties, as well as water repellent properties.

The inner and/or outer yarns could have stain release properties (i.e. to help wash out i.e. body oil stains such as underarm and collar stains). U.S. Pat. No. 5,377,249 discloses the use of an acrylic copolymer emulsion, an aminoplast resin and a resin catalyst to achieve this.) Stain release properties have recently been released by DuPont in their Teflon ranges and by Invista Inc in their moisture wicking fibres.

The outer layer is preferably woven or knitted.

Preferably the outer and inner layers form an integrated article of clothing.

The textile layer and/or wicking layer/yarns may contain metal colloids which can provide data storage, or transmit information. Alternatively, the metal colloids may be used as an anti-static measure, as in U.S. Pat. No. 0,201,960.

The fabric of the present invention will be demonstrated by way of the following non-limiting Examples.

EXAMPLE 1

A two layer laminate was produced by the following method. A breathable shirt material, i.e. a shirt material permeable to water vapour but resistant to liquid water, was provided. The shirt material was obtained from a 100% cotton shirt, the yarns of which had been subjected to a Nano-Pel fluorochemical treatment (Nano-Tex LLC). The treated shirt was obtained from Lands Ends. The weight of the shirt material was between 110-130 gsm and approximately 125 gsm. Nano-Pel (Nano-Tex LLC) is a treatment of bonding hydrophobic fluorinated polymers to the individual yarns. An inner layer fabric of low denier fibres was laminated to the textile layer as follows.

The following adhesives were employed in various separate tests: a web of breathable polyamide adhesive (Bostik), a web of breathable polyester adhesive (Colplan), and a web of breathable polyethylene (Rubinstein & Son Ltd). These webs were placed between the shirt material and the inner fabric (wicking) layer. The fabric was then subjected to a temperature of approximately 120 to 160° C. for approximately 10-20 seconds, or until the adhesive had melted and adhered the two layers together. The two layers were compressed while the adhesive was molten to aid adhesion. The fabrics were then left to stand until they reached room temperature. In a further test, 'chemical spray glue' from Rossendale Combining was applied to the shirt material at room temperature and the inner wicking layer contacted with the adhesive. The inner fabric (wicking) layer comprised 100% polyester low denier fibres that provided a double deodorising mechanism of photocatalytic reaction and chemical absorbing reaction. This inner layer was Claretta SP-99-Shine UP, manufactured by Kuraray. The low denier fibres formed a very light, knitted fabric. The weight of the inner layer alone was approximately 70 gsm. The knit construction allowed the resultant fabric to be comfortable and have a drape and handle similar to a standard cotton shirt.

EXAMPLE 2

In a further test, a breathable shirt material as used in Example 1 was provided. A very light knit (45-55 gsm) polyester fabric with a polyamide adhesive on one side was also provided. This inner layer fabric was Rubinstein's LK300 product. The polyamide adhesive was contacted with the shirt material and the fabric was subjected to a temperature of from 125-140° C. for 12 seconds, while being compressed under a pressure of 4 bar on Kannegeisser's scale. The fabric was then allowed to stand and cool to room temperature.

The resultant fabrics of Examples 1 and 2, when made into a shirt, were found to be able to wick moisture from a wearers skin, but allow perspiration through the fabric in the form of vapour. Application of liquid water to the interior side of the shirt did not discolour the out side of the shirt fabric, i.e. no water mark could be seen.

EXAMPLE 3

A fabric suitable for incorporation into a sporting garment (e.g. running shirt, cycling shorts etc) was also produced. The outer breathable layer was a woven 100% polyester low denier fibre (75 gsm) with durable water repellent finish attached to the individual fibres/yarns. This fabric was obtained from Carol Textile Company (Taiwan) and was termed 'microfibre with a water repellent chemical finish'. This fabric was very soft and you could not feel a finish on the fabric. Both the drapability and breathability of the treated fabric seemed substantially similar to an untreated fabric of the same weight. This is in part due to the individual fibres having being treated. Such a drapability would not be seen in a similar fabric had a breathable surface covering been applied to the fabric, instead of to the individual fibres.

The outer breathable fabric was laminated to the wicking layer using a breathable polyamide web adhesive (Bostik) by placing the web between the two layers and subjecting the fabric to a temperature of 140° C. for approximately 10 seconds, or until the adhesive had melted and bonded the layers together. The inner wicking layer used was knitted-Claretta SP-99, which allowed the resultant fabric laminate to be relatively soft, light and supple. The fabric was able to wick liquid moisture, but allow the moisture to evaporate through the breathable layer. It was found that incorporation of Elastane fibres into the layers provided a material that was able to stretch further.

The resultant fabric of Examples 3, when made into a sporting garment, such as a running shirt, was found to be able to wick moisture from a wearers skin, but allow perspiration through the fabric in the form of vapour. Application of liquid water to the interior side of the garment did not discolour the out side of the shirt fabric, i.e. no water mark could be seen.

EXAMPLE 4

Fabric for Use as the Textile Layer

A cotton fabric having a water-repellent finish was produced using Rudolf Chemie's Bionic finish.

The cotton yarn on the bobbin was given:

Pre-Treatment:

2 g/l RUCO-TEX NKS 150

80° C./15 mins warm and cold rinsing

Finish:

| | | |
|---|---|---|
| Liquor ratio: | 1:10 | |
| Liquor circulation: | 2 min i/o and 4 min o/i | |
| Temperature: | 60° C. | |
| Time: | 10 min at final temperature | |
| Drying: | Temperature: | 100° C. |
| Curing: | Temperature: | 130° C. |
| | Curing Time: | 60 min |

The above treatment was applied to Nm 80/2 cotton yarn, which achieved excellent results regarding running behaviour, water and oil repellence. Below are the test results of the cotton yarn after its hydrophobic treatment.

Nm 80/2, White Cotton Yarn with Rucostar DDD:

| | |
|---|---|
| pH = | 6 |
| Friction | |
| Friction tester RK | |
| Fibre/metal wrapping friction | |
| Wrapping angle 180° | |
| 100 m/min | |
| pre-tension 10 cN | |
| Friction Value = | 0.19 |
| Coefficient of variation CV % = | 10.2 |
| Friction | |
| Fibre/metal wrapping friction | |
| wrapping angle 540° | |
| 150 m/min | |
| Friction Value = | 0.17 |
| Wicking Test | |
| Rising height after 4h = | 0 mm |
| Oil Repellence* | |
| AATCC 118/EN 14419 = | 6-7 |

*Oil repellency (in accordance with AATCC 118-1966). The test sample is placed on a flat horizontal surface, a droplet (droplet diameter about 5 mm) of test liquids 1 to 8 is applied by means of a dropping pipette to various points of the test sample, and, in accordance with the instructions, the result is assessed after 30 seconds in each case. The AATCC oil repellency level of a test fabric is the highest number of that test liquid which does not wet or penetrate the test material within a time span of 30 seconds. (1 = lowest repellency, 8 = highest repellency).

EXAMPLE 5

A single plain weave fabric comprising yarns treated with the Rucostar treatment of Example 4 integrally woven with cotton yarns was produced.

The yarns used were as follows:

Hydrophobic yarns=80/2 combed cotton yarn with Rucostar water/stain repellent treatment Wicking yarns=Nm 50/1 cotton yarns Wicking Yarn Properties:

| |
|---|
| Nm 50/1, white |
| Friction |
| Friction tester RK |
| Fibre/metal wrapping friction |
| Wrapping angle 180° |
| 100 m/min |
| pre-tension 10 cN |

-continued

| | |
|---|---|
| Friction Value = | 0.29 |
| Coefficient of variation CV % = | 8.3 |
| Friction | |
| Fibre/metal wrapping friction | |
| wrapping angle 540° | |
| 150 m/min | |
| Friction Value = | 0.33 |
| Wicking Test | |
| Rising height after 4h = | 153 mm |
| Degree of whiteness | |
| Acc. To Ganz/Griesser = | 222 |

Nm 80/2 Cotton (Hydrophobic) Yarn Properties:

| | |
|---|---|
| pH = | 6 |
| Friction | |
| Friction tester RK | |
| Fibre/metal wrapping friction | |
| Wrapping angle 180° | |
| 100 m/min | |
| pretension 10 cN | |
| Friction Value = | 0.19 |
| Coefficient of variation CV % = | 10.2 |
| Friction | |
| Fibre/metal wrapping friction | |
| wrapping angle 540° | |
| 150 m/min | |
| Friction Value = | 0.17 |
| Wicking Test | |
| Rising height after 4h = | 0 mm |
| Oil Repellence* | |
| AATCC 118/EN 14419 = | 67 |

*Oil repellency (in accordance with AATCC 118-1966). The test sample is placed on a flat horizontal surface, a droplet (droplet diameter about 5 mm) of test liquids 1 to 8 is applied by means of a dropping pipette to various points of the test sample, and, in accordance with the instructions, the result is assessed after 30 seconds in each case. The AATCC oil repellency level of a test fabric is the highest number of that test liquid which does not wet or penetrate the test material within a time span of 30 seconds. (1 = lowest repellency, 8 = highest repellency).

The fabric of the present invention was produced according to the weaving pattern shown in FIG. 3. The fabric comprises one warp yarn and two weft yarns. The warp yarn and one of the weft yarns are the hydrophobic Nm 80/2 cotton yarns and the other weft yarn is the Nm 50/1 cotton wicking fibre. The wicking weft yarns are termed-'weft floats'. The resultant fabric is shown in FIG. 4.

This fabric is ideal for a 100% cotton shirting material. The outer hydrophobic yarn is woven as a twill but it can be made lighter by weaving the outer yarns as a plain weave.

It has been found that the resultant single woven fabric, which has wicking weft floating yarns attached to the textile layer comprising hydrophobic yarns results in a very soft & light fabric with a natural handle. The fabric is indistinguishable to any normal single woven fabric without any surface effects. The outside of the resultant fabric is both oil and water repellent and the inside is excellent at drawing moisture away from the skin. The perspiration which is drawn away from the skin, by the wicking floating yarns, leaves the fabric through the textile layer as moisture vapour. As the outer yarns are hydrophobic, the moisture on/in the wicking fibres are not absorbed by the outer yarns, therefore no perspiration marks are present. It was also apparent that the fabric was crinkle resistant as the outer yarns did not swell as much due to the stain/water repellent finish attached to it.

EXAMPLE 6

A polyester yarn, 110/90 (whereby 110 indicates the linear density in Decitex of the yarn and 90 indicates the number of filaments in the yarn), supplied by Sinterama, was treated with a Teflon finish at yarn level and cured at 150 degrees celcius.

A polyamide yarn which was rendered hydrophilic, 110/68, was supplied by Nylstar, namely Meryl Nateo.

These two yarns were woven into a single woven fabric in accordance with the same weaving pattern as shown in FIG. 3, with weft wicking floating yarns attached to the polyester's yarns intersections, as highlighted in FIG. 5C. The resultant fabric is ideal for a sportswear fabric which is wicking from the inside and rain/stain resistant from the outside. The fabric is both light and soft.

EXAMPLE 7

A 2ply cotton yarn, Nm 80/2, was treated with a stain and water repellent finish (Rudolf Chemie's Rucostar DDD) at yarn level.

A standard 2ply cotton yarn, Nm 80/2, was supplied and was scoured at yarn level. The scouring process removed any waxes etc from the cotton, allowing it to be able to wick moisture.

The two yarns were woven together in a double weave structure, as shown in Example 5D. This produced a slightly thicker fabric, ideal for a chef's jacket, for example. The outer face of the fabric had 100% stain/water repellent fibres and the inner face had 97% wicking fibres. The resultant fabric had a soft handle and was excellent at wicking moisture away from the skin, with the outer face being very hydrophobic.

Examples 4, 5, 6 & 7 shows that as the textile layer yarns were coated with a hydrophobic (water repellent) finish, as opposed to the textile layer being coated, this not only ensured that the handle and the ability of the fabric to allow water vapour through the textile layer were both good, but the durability of the water repellent finish on the outer yarn and wicking performance of the inner yarn was much improved. Little, if any, migration of the hydrophobic finish to the wicking yarns was seen. When a surface coating (ie fluorocarbon coating) is normally applied to the entire textile layer at fabric level, this normally has problems as it is difficult not to coat (or cross-contaminate or penetrate) both sides of the textile layer and give both sides hydrophobic qualities. For example, when a fluorocarbon is applied to the surface layer of a fabric, (ie face of the fabric) at fabric level, the fluorocarbon usually penetrates through/or adheres to the other side of the fabric (Back of the fabric). Applying the coatings at yarn level ensures a durable, soft, highly breathable and effective fabric with opposing functions (hydrophobic and hydrophilic) on either textile surface.

It has been found that a very fine and thin layer/yarn of wicking fibres, particularly low denier fibres and/or microfibres, when combined with an outer textile layer/yarn as described herein produces a fabric with a comfortable, soft feel, that is able to wick moisture. When combined with a breathable textile layer/yarn as herein described that comprises cotton, wool, or other fibres traditionally used for clothing garments, the resultant fabric has a drape and handle of a similar textile layer that is permeable to liquid water.

As well as the application of the fabric of the present invention to clothes, the fabric of the present invention may be used as discussed below.

The present invention further provides an article for covering a piece of furniture, said article comprising the fabric of the present invention.

The article for covering a piece of furniture may be an article of bed linen, including but not limited to, a pillow case, a quilt cover or a laminate bed sheet. The article may cover or be part of a mattress.

The invention further comprises an article of furniture covered at least in part by the article for covering a piece of furniture. Preferably the wicking means is disposed on the side of the fabric that would face a human user of the furniture, i.e. the outer side of the article. The article of furniture may be selected from a chair, sofa, wheelchair, car seat, mattress or stool seat. The fabric may cover the back, arms, or seat, or combination thereof, of these articles.

The present invention further provides an article for covering a handle-grip, said article comprising a fabric of the present invention. In use, the wicking means would be disposed on the outside of the covering of the handle grip.

The present invention further provides a handle-grip comprising the article for covering a handle grip.

The invention further provides a receptacle, said receptacle comprising or consisting a fabric of the present invention.

The wicking means may be disposed on the exterior of the receptacle. In such case, the receptacle may be selected from a purse or wallet.

Alternatively, the wicking means may be disposed on the interior side of said receptacle. In such case, the receptacle may be a sleeping bag, a rucksack, handbag, shoulder bag, sports bag, beach bag or suitcase.

The present invention further provides an article for covering or incorporation into a floor, wall or ceiling, said article comprising a the fabric of the present invention. The wicking means may be disposed on the side of the textile layer facing the floor, wall or ceiling or disposed on the side of the textile layer facing away from the floor, wall or ceiling. The article may be selected from a rug, a carpet, bath mat, wall paper, tiles, floor board, structural members of a wall, floor or ceiling, the fabric roof of a cabriolet car.

The present invention further provides an article for covering piping, said article comprising the fabric of the present invention. Preferably, in use, the wicking means is disposed on the side of textile layer facing the pipe.

The invention claimed is:

1. A single-weave fabric comprising a woven textile layer that is permeable to water vapor and impermeable to liquid water and comprising hydrophobic warp and weft yarns and floating warp or weft wicking yarns or fibres, wherein the floating warp or weft wicking yarns or fibres are integrally woven with the hydrophobic yarns, and the hydrophobic warp and weft yarns and the floating warp or weft wicking yarns or fibres together form the single weave fabric, and wherein the textile layer has two opposing sides and the wicking yarns or fibres are disposed on at least part of one side of the textile layer, and the other side has more than 70% hydrophobic yarns exposed.

2. The fabric as claimed in claim 1 wherein said hydrophobic warp and weft yarns comprise one or more materials selected from the group consisting of polyester, polyarn ides, polyvinyl alcohols, lyocell, rayon, viscose, nylon, cotton, linen, flax, hemp, jute and wool, acetates, acrylic, elastane, and silk, and wherein said hydrophobic warp and weft yarns comprise hydrophobic molecular moieties bound to the individual yarns and/or to individual yarn fibres that constitute at least part of the yarns.

3. The fabric as claimed in claim 2 wherein the textile layer is formed from woven yarns and the hydrophobic molecular moieties have been applied to the individual yarns and/or individual yarn fibres before the fabric is woven.

4. The fabric as claimed in claim 2 wherein at least some of the hydrophobic molecular moieties constitute molecules that are directly or indirectly non-covalently bound to the yarns and/or yarn fibres that constitute at least part of the yarns.

5. The fabric as claimed in claim 2 wherein at least some of the hydrophobic molecular moieties are chemical groups that are directly or indirectly covalently bonded to the yarns and/or yarn fibres that constitute at least part of the yarns.

6. The fabric as claimed in claim 2 wherein the hydrophobic molecular moieties comprise hydrophobic molecules or hydrophobic chemical groups.

7. The fabric as claimed in claim 6 wherein the hydrophobic molecules or chemical groups comprise hydrophobic fluorinated polymeric hydrocarbon groups.

8. The fabric as claimed in claim 1 wherein the wicking yarns or fibres comprise floating yarns or fibres, the majority of the lengths of which are disposed on one side of the textile layer.

9. The fabric as claimed in claim 1 wherein said wicking fibres or yarns are floating weft fibres or yarns.

10. The fabric as claimed in claim 1 wherein the wicking yarns or fibres include fibres comprising cellulosic fibres, polyamide fibres and/or hydrophilic natural fibres.

11. An article of clothing comprising the textile fabric of claim 1:

wherein said side on which the wicking yarns or fibres are disposed is disposed on an inside of the article and intended to face toward a wearer of the article; and wherein said other side having more than 70% hydrophobic yarns exposed is disposed on an outside of the article and intended to face away from the intended wearer of the fabric.

12. The article as claimed in claim 11 wherein the article is selected from a shirt, T-shirt, vest, poly top, pullover, male or female brief, underwear, longjohn, nightwear such as pyjamas, sportswear top, bra, cardigan, skit, dress, blouse, trousers, tracksuit bottom, shorts, sock, tie, pair of jeans, glove, coat, jacket, boxing glove, mitt, hat, cap, skull cap, helmet, dressing gown, baby clothing such as nappies and bibs, garments such as gowns, drapes, overalls, masks, uniforms such as chefs jackets and aprons, and inner lining of clothing and towels.

13. A method of making the fabric as claimed in claim 1, the method comprising:

providing the hydrophobic yarns and wicking yarns, weaving the hydrophobic yarns and the wicking yarns into the single-weave fabric so that the hydrophobic yarns are both warp and weft yarns and the wicking yarns are floating yarns, wherein the majority of the lengths of the wicking yarns are disposed on one side of the fabric and integrally woven with the hydrophobic yarns.

14. The method of claim 13:

wherein said weaving comprises integrally weaving the yarns for making the fabric and the wicking yarns into a textile layer such that the majority of the lengths of the wicking yarns are disposed on one side of the fabric, and before, during or after said weaving treating the yarns of the textile layer to form hydrophobic yarns, such that the resultant textile layer is permeable to water vapour and impermeable to liquid water.

15. A method of making an article of clothing comprising providing a fabric as defined in claim 1, forming said article of clothing from said textile fabric, optionally using one or more other fabrics that are permeable to liquid water and water vapour.

16. A fabric obtainable by a method as defined in claim 13.

17. An article of clothing obtainable by a method as defined in claim 15.

18. The fabric of claim 1 wherein said other side having more than 70% hydrophobic yarns exposed is adapted to face away from an intended wearer of the fabric.

19. The fabric of claim 1 wherein said other side has at least 80% hydrophobic yarns exposed.

20. The fabric of claim 19 wherein said other side having at least 80% hydrophobic yarns exposed is adapted to face away from an intended wearer of the fabric.

21. The fabric of claim 1 wherein said other side has at least 90% hydrophobic yarns exposed.

22. The fabric of claim 21 wherein said other side having at least 90% hydrophobic yarns exposed is adapted to face away from an intended wearer of the fabric.

* * * * *